US007341360B2

(12) United States Patent
Richmond et al.

(10) Patent No.: US 7,341,360 B2
(45) Date of Patent: Mar. 11, 2008

(54) DECORATING WITH A LIGHTED DEVICE

(75) Inventors: Rebecca M. Richmond, Overland Park, KS (US); Ronald L. Carlson, Riverside, MO (US); Therese F. Steiger, Liberty, MO (US); Brenda S. Klenke, Kansas City, MO (US); Keri Lauderdale Olson, Lee's Summit, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 180 days.

(21) Appl. No.: 11/241,864

(22) Filed: Sep. 29, 2005

(65) Prior Publication Data

US 2007/0070627 A1 Mar. 29, 2007

Related U.S. Application Data

(60) Provisional application No. 60/722,232, filed on Sep. 29, 2005.

(51) Int. Cl.
*F12V 33/00* (2006.01)

(52) U.S. Cl. ..... 362/240; 362/605; 362/806; 362/812

(58) Field of Classification Search ..... 362/240, 362/244, 248, 249, 251, 252, 311, 351, 565, 362/605, 644, 806, 808, 809, 812; 428/7, 428/11, 13

See application file for complete search history.

(56) References Cited

U.S. PATENT DOCUMENTS

| | | | |
|---|---|---|---|
| 1,288,145 | A | 12/1918 | Noville |
| 1,930,359 | A | 10/1933 | Hilgenberg |
| 2,059,653 | A | 11/1936 | Pretzfelder |
| 2,199,434 | A | 5/1940 | Koonz |
| 2,199,435 | A | 5/1940 | Koonz |
| 2,207,117 | A | 7/1940 | Collins |
| 2,345,517 | A | 3/1944 | Weiss |
| 2,653,216 | A | 9/1953 | Protz |
| 2,671,286 | A | 3/1954 | Hansen |
| 2,839,670 | A | 6/1958 | Gladstone |
| 2,918,034 | A | 12/1959 | Neugass |
| 3,400,263 | A | 9/1968 | Yakim |
| 3,694,648 | A | 9/1972 | Yates |
| 3,873,880 | A | 3/1975 | Riddell |
| 4,339,787 | A | 7/1982 | Burnbaum |
| 4,475,298 | A | 10/1984 | Munoz |
| 4,601,924 | A | 7/1986 | Birkes et al. |
| 4,782,434 | A | 11/1988 | Cole |

(Continued)

OTHER PUBLICATIONS

OmaGlow product packaging, 1 page, believed to have been publicly available before Jun. 1, 2005.

(Continued)

*Primary Examiner*—Y. My Quach-Lee
(74) *Attorney, Agent, or Firm*—Fish & Richardson P.C.

(57) ABSTRACT

A decoration device may include a backlit panel inside an interior space of an ornament structure. The panel may include a decorative scene that is viewable from outside the ornament structure, and one or more light sources may be substantially aligned with certain elements of the scene (e.g., candles, a fireplace, stars, or the like) so that those elements have the appearance of emitting light that illuminates other portions of the decorative scene.

25 Claims, 16 Drawing Sheets

U.S. PATENT DOCUMENTS

| | | | | |
|---|---|---|---|---|
| 4,833,580 | A | 5/1989 | Allen | |
| 4,866,580 | A | 9/1989 | Blackerby | |
| 4,930,053 | A | 5/1990 | Vaught | |
| 4,942,685 | A | 7/1990 | Lin | |
| 4,975,809 | A | 12/1990 | Ku | |
| 5,124,890 | A | 6/1992 | Choi et al. | |
| 5,250,331 | A | 10/1993 | Grefalda | |
| 5,266,771 | A | 11/1993 | Van Wyk | |
| RE34,717 | E | 9/1994 | Sanders et al. | |
| 5,378,512 | A | 1/1995 | Van Wyk | |
| 5,576,078 | A | 11/1996 | Schatz | |
| 5,613,764 | A | 3/1997 | O'Brien | |
| 5,743,616 | A | 4/1998 | Giuliano et al. | |
| 5,772,312 | A | 6/1998 | Pihl-Niederman et al. | |
| 5,813,747 | A | 9/1998 | Kale | |
| 5,820,251 | A | 10/1998 | Greenberg et al. | |
| 5,828,183 | A | 10/1998 | Wang et al. | |
| 5,865,533 | A | 2/1999 | Liu | |
| 5,876,112 | A | 3/1999 | Wu | |
| 6,000,820 | A | 12/1999 | Murray | |
| 6,048,591 | A | 4/2000 | Zwiebel | |
| 6,135,599 | A | 10/2000 | Fang | |
| 6,143,381 | A | 11/2000 | Hawkins | |
| 6,145,228 | A | 11/2000 | LaChance | |
| 6,224,230 | B1 | 5/2001 | Roegiers | |
| 6,285,472 | B1 | 9/2001 | Odhner et al. | |
| 6,361,198 | B1 | 3/2002 | Reed | |
| 6,398,388 | B1 | 6/2002 | Lorenzana et al. | |
| 6,399,167 | B1 | 6/2002 | Lewis, Jr. | |
| 6,439,723 | B1 | 8/2002 | Tano | |
| 6,552,831 | B2 | 4/2003 | Odhner et al. | |
| 6,652,349 | B1 | 11/2003 | Wichter | |
| 6,672,738 | B1 | 1/2004 | Lewis et al. | |
| 6,712,493 | B2 | 3/2004 | Tell et al. | |
| 6,764,205 | B2 | 7/2004 | Peloquin | |
| 6,832,842 | B2 | 12/2004 | Sullivan | |
| 7,022,387 | B1 * | 4/2006 | Fertig | 428/11 |
| 7,086,770 | B2 | 8/2006 | Tell et al. | |
| 7,111,955 | B2 * | 9/2006 | Tsai et al. | 362/806 |
| 2003/0210541 | A1 | 11/2003 | Long | |
| 2004/0207341 | A1 | 10/2004 | Callahan | |
| 2004/0223326 | A1 | 11/2004 | Wainwright | |
| 2004/0257007 | A1 | 12/2004 | Lys et al. | |

OTHER PUBLICATIONS

Holiday Living product packaging, 5 pages, 2004.

* cited by examiner

DECORATING WITH A LIGHTED DEVICE

RELATED APPLICATIONS

This application claims the benefit of U.S. patent application Ser. No. 60/722,232, filed on Sep. 29, 2005, by Rebecca M. Richmond, et al., and entitled Lighted Ornaments, the entirety of which is hereby incorporated by reference.

TECHNICAL FIELD

This document relates to decorating with a lighted device, such as a holiday ornament.

BACKGROUND

Decorations are often used as part of a celebration of an event or a season. For example, a living area or a shopping mall may be decorated with one or more decorations that are associated with a particular holiday season. These holiday decorations may have a religious meaning, may be used for entertainment purposes, or a combination thereof.

In some circumstances, lighting effects may be used to provide a desired appearance to the decorations. The decorations may include candles, electrical light bulbs, or other instruments that illuminate portions of the decoration to enhance the appearance of the decorations. The lighting effects may be used, for example, to provide a glowing appearance when the decoration is displayed during the nighttime hours or in an otherwise dark environment.

Some decorations are often configured to be bulbs or ornaments that are stand-alone decorations or are used individually or collectively to enhance the decorative appearance of other objects. For example, some bulbs or ornaments may be disposed on a table top or other surface and serve as a stand-alone decoration. In another example, some bulbs or ornaments can be disposed on a tree or other object so as to enhance the appearance of that particular tree or object.

Certain bulbs or ornaments are augmented with lighting effects to provide a desired appearance. The bulbs or ornaments may include electrical light bulbs or other instruments that illuminate portions of that particular bulb or ornament or that illuminate the surfaces or neighboring bulbs or ornaments. In one example, a series of bulbs or ornaments may be equipped with electrical lights so as to collectively provide a desired glowing appearance during the nighttime hours.

SUMMARY

A decoration device may include a backlit panel inside an interior space of an ornament structure. The panel may include a decorative scene that is viewable from outside the ornament structure, and one or more light sources may be substantially aligned with certain elements of the scene (e.g., candles, a fireplace, stars, or the like) so that those elements have the appearance of emitting light that illuminates other portions of the decorative scene. In some embodiments, the ornament structure may provide a glowing appearance with the use of light-piping effects and edge-lighting effects while the panel scene may provide a realistic lighting appearance with the use of backlighting effects.

In one illustrative embodiment, a decoration device may include an ornament structure having an opening through which an interior space of the ornament structure is viewable. The device may also include a panel disposed in the interior space. The panel may have a decorative scene displayed on a front side of the panel such that the decorative scene is viewable through the opening. The panel may also have at least one substantially opaque portion aligned with the decorative scene and at least one substantially transparent or translucent portion aligned with the decorative scene. The device may further include at least one light source disposed rearwardly of the panel such that light emitted from the light source is viewable through the substantially transparent or translucent portion of the panel and through the opening of the ornament structure.

In another illustrative embodiment, a decoration system may include first and second decoration devices. The first decoration device may include an ornament structure having an opening through which an interior space of the ornament structure is viewable, and a first panel disposed in the interior space. The first panel may have a first decorative scene displayed on a front side of the first panel such that the first decorative scene is viewable through the opening. Also, the first panel further may have at least one substantially opaque portion aligned with the first decorative scene and at least one substantially transparent or translucent portion aligned with the first decorative scene. The first decoration device may also include a first light source disposed rearwardly of the first panel such that light emitted from the first light source is viewable through the substantially transparent or translucent portion of the first panel and through the opening of the ornament structure. The second decoration device may include a second panel having a second decorative scene that is different from the first decorative scene. The first and second decorative scenes may collectively display at least a portion of a storyline associated with a holiday or season.

These and other embodiments may be configured to provide one or more of the following advantages. First, a decoration device may employ panel light sources and a decorative panel scene to provide pleasing appearance to a viewer. Second, the light from the panel sources may transmit through substantially transparent or translucent portions of the panel scene to provide a realistic lighting effect. For example, the panel scene may include a candle image that is aligned with a transparent portion of the panel. In such circumstances, the light from the panel light source may pass through the transparent portion and shine from the candle image so that the candle image has the appearance of emitting light onto other portions of the panel scene. Third, the decoration device may employ light-piping effects and edge-lighting effects to give a glowing appearance the ornament structure and to highlight certain design elements formed into the ornament structure body. Fourth, the decoration device may include a programmable controller that is capable of independently controlling a plurality of internal light sources to enhance the light-piping, edge-lighting, and backlighting effects. One or more of these and other advantages may be provided by the devices described herein.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
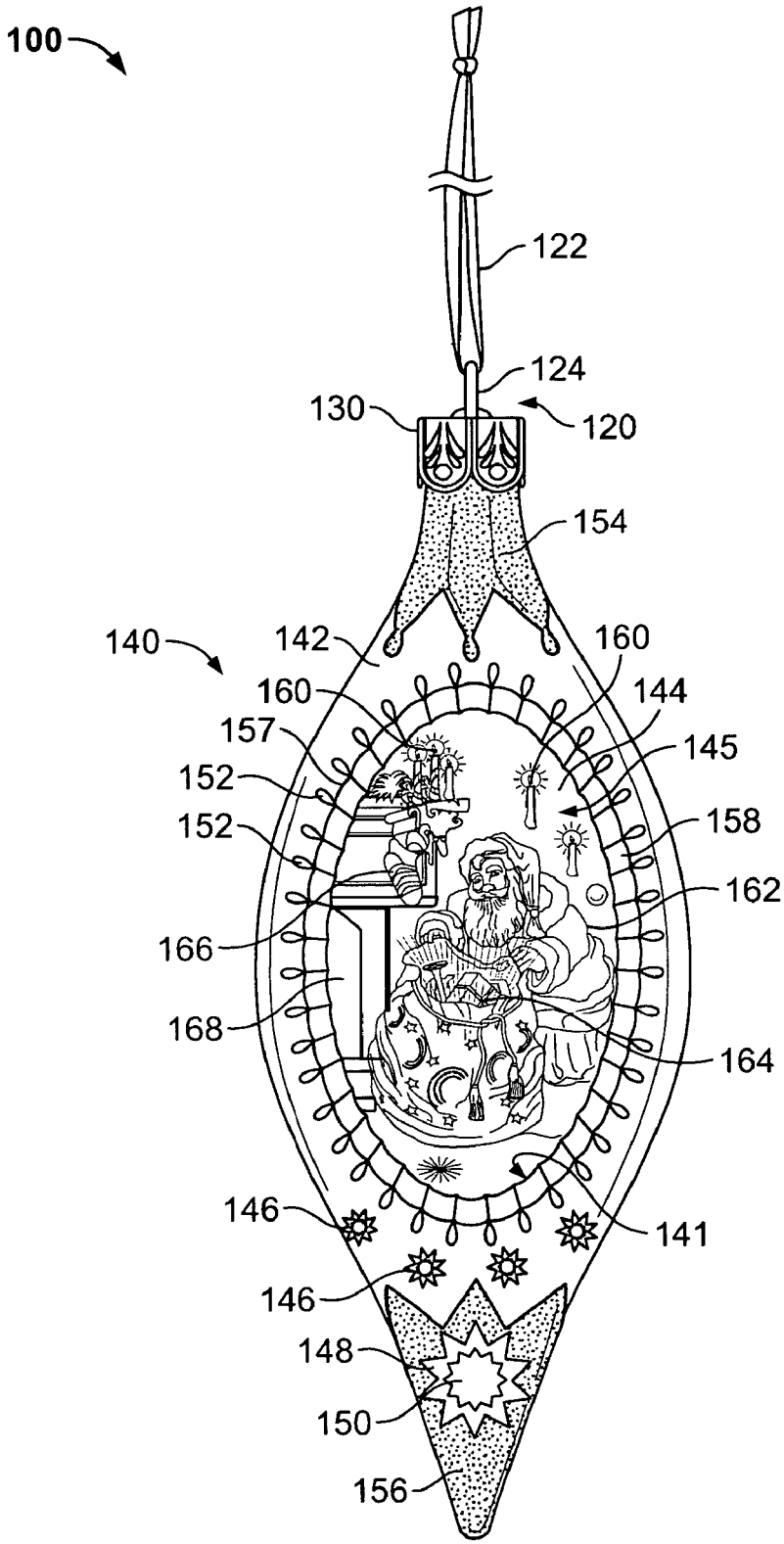
FIG. 1 is a front view of decoration device in accordance with some embodiments of the invention.

Referring to FIG. 1, a decoration device 100 may include an attachment mechanism 120 and an ornament structure 140. In this embodiment, the attachment mechanism 120 comprises a ribbon 122 and a metal ring 124. The metal ring 124 is coupled to a decorative cap member 130 of the ornament structure 140. As such, the attachment mechanism 120 may releasably couple the ornament structure 140 to an external object, such as a hook on a wall, a doorknob, a railing, or a branch of a Christmas tree.

The ornament structure 140 may include a front portion 142, which may include one or more decorative elements that are configured to resemble patterns, characters, or words that may be associated with a particular season or holiday. In this embodiment, the decorative elements on the front portion 142 include a plurality of small debossed decorative stars 146, a large debossed decorative star 148, a debossed faceted star 150, a plurality of embossed teardrops 152, and glitter patterns 154 and 156. In certain embodiments, the sum of the decorative elements may be associated with the Christmas holiday season. The front portion 142 may define an aperture 157 that provides viewability to an interior space 141 (refer also to FIG. 5) of the ornament structure 140. In some embodiments, the aperture 157 may include a decorative border 158, such as a scalloped oval frame.

Still referring to FIG. 1, a decorative panel 144 may be disposed in the interior space 141 of the ornament structure 140. The panel 144 may include a decorative scene 145 disposed on a front side of the panel 144. In such circumstances, the scene 145 disposed on the panel 144 may be viewed through the aperture 157. The decorative scene 145 may be configured to resemble patterns, characters, scenes or words that are associated with a particular season or holiday. Some portions of the scene 145, such as candles 160, fireplaces 168, nighttime stars, or the like, may resemble objects that shed light on other portions of the scene 145. In this embodiment, the decorative panel 144 is configured as a scene from Santa's visit on Christmas Eve and includes a plurality of candles 160, Santa Claus 162, Santa's Magic Bag 164, a stocking 166, and a fireplace 168.

In some embodiments, at least a portion of the panel 144 may include a curved surface to provide a three-dimensional scene. In such circumstances, the panel 144 may comprise a plurality of panel scene subparts in which at least one of the subparts is curved to correspond to a decorative element of the scene 145. For example, Santa's Magic Bag 164 and Santa Claus 162 may comprise curved panel subparts (refer also to FIG. 5). These two panel subparts 162 and 164 may be part of an assembly that includes a light feature (described in more detail below).

Figure 2:
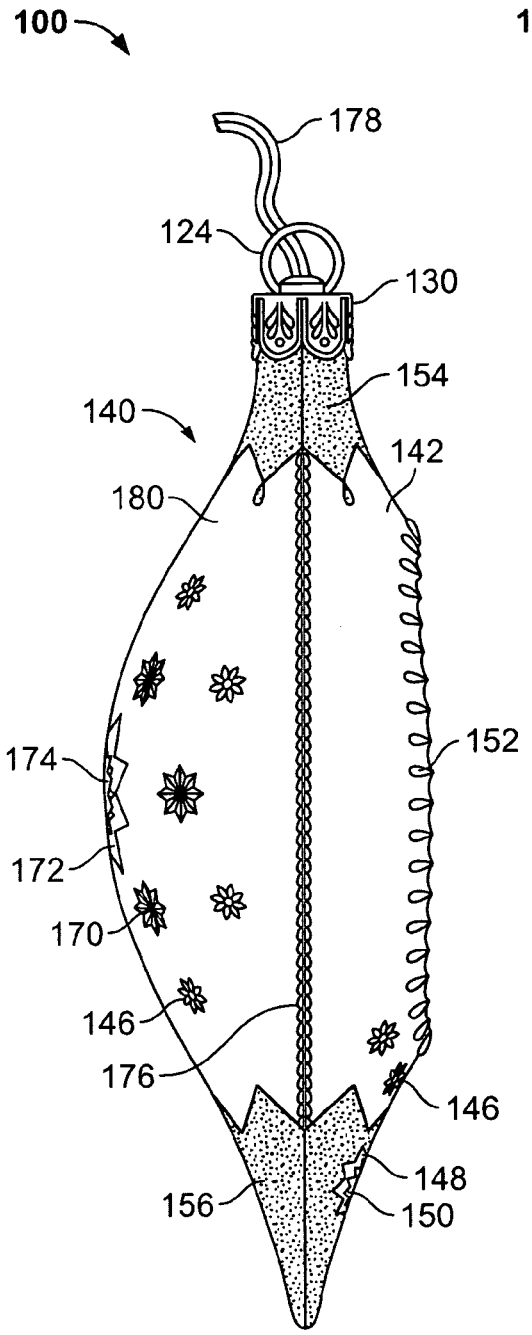
FIG. 2 is a cross-sectional side view of the decoration device of FIG. 1.
Figure 3:
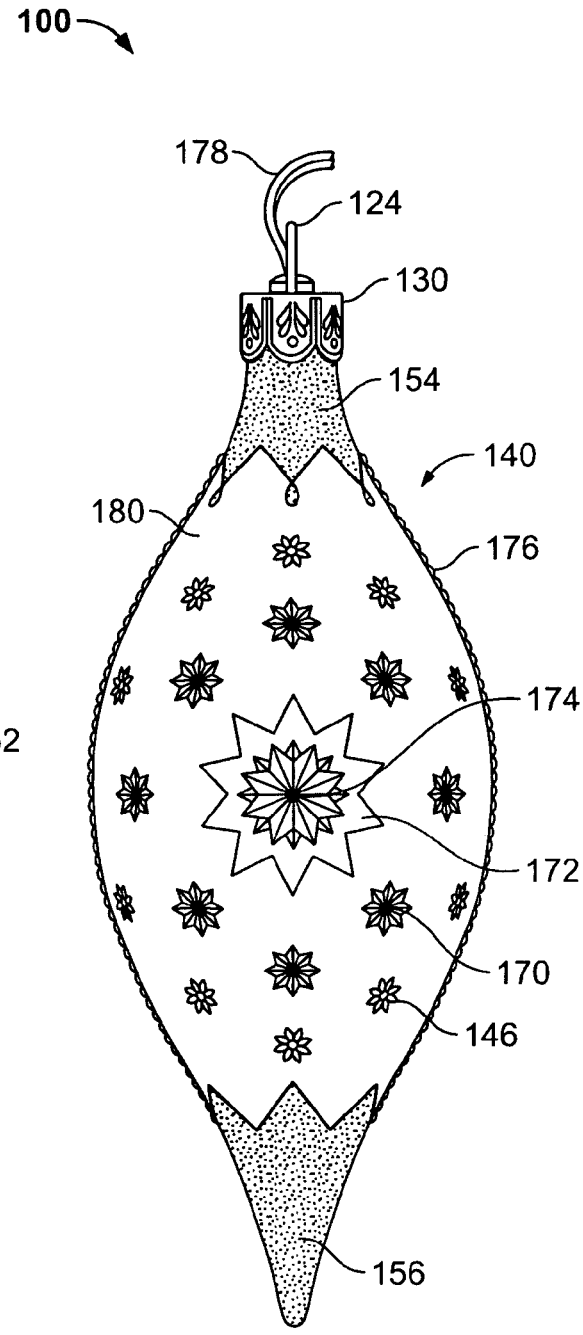
FIG. 3 is a sectional front view of a portion of the decoration device of FIG. 1.

Referring to FIGS. 2-3, the ornament structure 140 may include a rear portion 180 that is disposed opposite to the front portion 142. The rear portion 180 may include one or more decorative elements that are configured to resemble patterns, characters, or words that may be associated with a particular season or holiday. In this embodiment, the decorative elements on the rear portion 180 include a plurality of small debossed decorative stars 146, a plurality of small debossed faceted stars 170, a large debossed decorative star 172, a large debossed faceted star 174, and the previously mentioned glitter patterns 154 and 156. As described in more detail below, the larger stars 172 and 174 may be provided with backlighting effects such that those elements 172 and 174 emit a brighter light than other elements.

Figure 5:
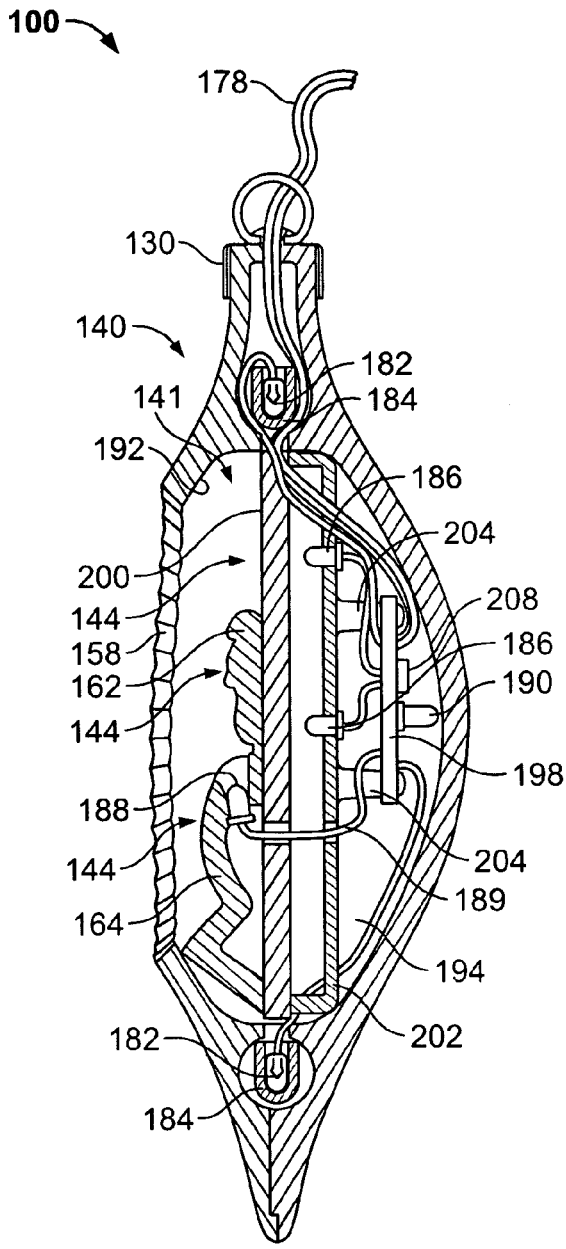
FIG. 5 is a rear view of the decoration device of FIG. 1.

As previously described, the ornament structure 140 may be substantially hollow such that an internal space 141 is defined between the front portion 142 and the rear portion 180. One or more internal light sources 182, 186, 188, and 190 may be disposed at least partially in the internal space 141 (as shown in FIG. 5). The ornament structure 140 may comprise a substantially transparent or translucent, light transmissive, and flame resistant polymer material, such as ABS (acrylonitrile butadiene styrene).

The ornament structure 140 may employ light from the internal light sources to provide lighting effects such as light-piping and edge lighting. In such circumstances, the front portion 142 and the rear portion 180 may have a low-level glow, while substantially brighter light may be emitted through the decorative panel 144 disposed in the internal space 141. A translucent coating may be applied to the exterior of the ornament structure 140 to enhance and control the quality of light that is emitted through the front and rear portions 142 and 180. Certain internal light sources (e.g., light sources 182 and 190 in FIG. 5) may be transmitted through the material of the front and rear surface portions 142 and 180 so as to emit substantially brighter light through a plurality of some decorative elements on the front and rear portions 142 and 180 of the ornament structure 140. In this embodiment, the decorative elements that emit light transmitted through the front and rear surface portions 142 and 180 include, but are not limited to, the plurality of small debossed deco stars 146, the debossed faceted star 150, the embossed teardrops 152, the scalloped oval frame 158, the small debossed faceted stars 170, and the large debossed faceted star 174.

Still referring to FIGS. 2-3, an electrical wire 178 may pass into the internal space to electrically connect the one or more internal light sources with an external power source. In this embodiment the electrical wire 178 passes through the cap member 130 proximal to the top portion of the decoration 100. As described in more detail below, the electrical wire 178 may join with a circuit 198 a controller unit 208 (FIGS. 5 and 6) that is capable of selectively illuminating and fading the internal light sources 182, 186, 188, and 190 (FIG. 5) in the decoration 100.

The front portion 142 and the rear portion 180 may be formed as separate shell halves that are subsequently coupled to one another. Each portion 142 and 180 may be constructed of a polymer or other moldable material that may be formed to the desired shape. As mentioned previously, the front and rear portions 142 and 180 may be formed of a substantially flame resistant polymer material, such as ABS (acrylonitrile butadiene styrene). The front portion 142 and the rear portion 180 may be coupled to one another along a border region 176. The border region 176 may include a decorative design that adds to the attractive appearance or theme of the decoration 100. In this embodiment, the decorative design of the border region 176 is embossed into the polymer material in the area proximal to where the front portion 142 meets the rear portion 180. The cap member 130 may be affixed to the front and rear portions 142 and 180 after the portions 142 and 180 have been joined along the border region 176. The internal light sources 182, 186, 188, and 190 (FIG. 5) and the decorative panel 144 may be assembled into the internal space of the decoration 100 before the front portion 142, the rear portion 180, and the cap member 130 are affixed to one another.

Figure 4:
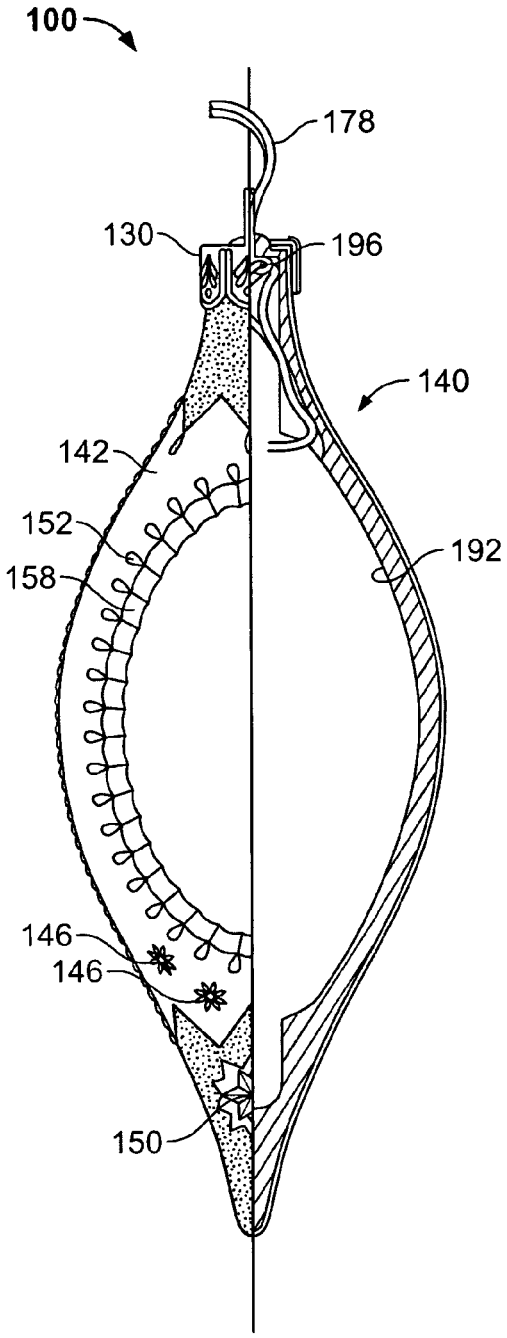
FIG. 4 is a side view of the decoration device of FIG. 1.

Referring to FIGS. 4-5, the decoration 100 may include a plurality of internal light sources to provide the previously described light-piping effect, to enhance the decorative scene 145 of the panel 144, to provide backlighting effects or a combination thereof. For example, the decoration 100 may include two body light sources 182 that are disposed proximal to the top and bottom of the decoration 100. These body light sources 182 may be configured to transmit light through the body material of the front and rear portions 142 and 180 to provide light-piping effects. This may cause the front and rear portions 142 and 180 to emit a low level glow while some or all of the decorative elements (e.g., stars 147 and 170) may be more brightly lit through edge-lighting effects. In addition, the decoration 100 may include panel light sources 186 and 188, for example, that are positioned proximal to the panel 144 to enhance the decorative scene 145 disposed on the panel 144. Further, the decoration 100 may include a rear light source 190 that is positioned proximal to the rear debossed star 174 so as to provide backlighting effects for the stars 172 and 174. In this embodiment, the light sources 182, 186, 188, and 190 may be electrically connected to an external power source via the wire 178. The wire 178 may include a knot and glue 196 assembly that is capable of providing strain relief when the wire 178 is pulled in tension.

In the embodiment depicted in FIG. 5, the body light sources 182 may comprise high-brightness incandescent lamps disposed in cavities proximal to the top and bottom of the ornament structure 140. The incandescent lamps 182 may have a brightness of at least 0.25 MSCP (Mean Spherical Candlepower) and may provide a constant source of light when power is supplied to the decoration 100. The lamps 182 may have lamp covers 184 that comprise a substantially transparent and flame resistant polycarbonate material. The light supplied by the lamps 182 may be light-piped through the substantially translucent polymer of the front and rear portions 142 and 180 to create a glowing effect throughout the outer surface of the ornament structure 140 and in a plurality of the design elements (e.g., 146, 148, 150, 170, 172, and 174). In some circumstances, the light piped through the front and rear portions 142 and 180 may provide lighting to the inside the ornament structure 140 to illuminate the foreground of the decorative panel 144. The intensity of the foreground lighting on the decorative panel 144 may be controlled by a frosted coating 192 applied to the inner surface of the front portion 142. For example, if a substantial layer of an opaque, white coating is applied to the inner surface of the front portion 142, the intensity of the light transmitted from the lamps 182 to the interior space 141 may be low. Additionally, the light piped through the substantially transparent or translucent polymer material of the front and rear portions 142 and 180 provides edge-lighting effects to the surface elements of the ornament structure 140, for example, to illuminate the plurality of small debossed decorative stars 146, the debossed faceted star 150, the embossed teardrops 152, the scalloped oval frame 158, and the small debossed faceted stars 170. As previously described, the backlighting for the large debossed faceted star 174 may be provided by the rear light source 190. The rear light source 190 may comprise a high brightness white LED that is electrically connected to the controller unit 208 of the circuit 198. The intensity of the light transmitted through the outer surface of the ornament structure 140 may be controlled by a translucent coating applied to the outer surface of the front and rear portions 142 and 180.

Referring to FIG. 5, the illumination of particular design elements of the decorative panel 144 may be accomplished using constantly powered or synchronized lighting effects (e.g., power on, power off, flicker, fade, varying colors, or varying levels of brightness). In this embodiment, the decorative panel 144 incorporates four light sources (three of panel light source 186 and one of panel light source 188) that may be placed inside or behind the panel subparts 162, 164, and 200. The decorative panel 144 may include opaque portions and substantially transparent (or translucent) portions. As such, the substantially transparent (or translucent) portions may be aligned with design elements of the decorative scene 145 that have the appearance of emitting light (e.g., a candle, a fireplace, a star, etc.). For example, an opaque mask may be applied to portions of the curved panel subparts 162, 164 and the primary panel subpart 200 to provide opaque portions that shield light from passing through certain design elements (e.g., Santa Claus character 162) of the decorative scene 145. In some embodiments, the decorative scene 145 (FIG. 1) may be integral with the opaque masking or may be printed over portions of the masking. For example, a lithographic printed polymer sheet may be applied to the front of each of the panel subparts 162, 164, and 200 to enhance the decorative appearance of the decorative panel 144 and to define opaque portions of the panel 144. As shown in FIGS. 1 and 5, the light from the panel light sources 186 is transmitted through the transparent or translucent portions of the primary panel subpart 200 and directed towards the candles 160 and the fireplace 168 of the decorative scene 145. In such circumstances, the candles 160 and the fireplace 168 have the appearance of emitting light that illuminates other portions of the decorative scene 145. Thus, the light from the panel lights 186 may pass through the substantially transparent or translucent portions proximal the candles 160 and the fireplace 168 to shine upon, for example, the Santa Claus character 162, but the light from the panel lights 186 will not necessarily pass through the opaque portions of the panel 144 to transmit through the Santa Claus character 162. To provide a realistic appearance of candle or fireplace light, the panel sources 186 may comprise three diffused yellow LEDs that are electrically connected to circuit 198. The light effects of panel sources 186 may be controlled to simulate the random twinkle and the glow of light from the candles 160 and from the fire place 168.

Although panel light sources 186 may be disposed rearwardly of the primary panel 200, at least one panel light source 188 may be housed inside or between one or more panel subparts 162, 164, and 200. For example, the light effects in Santa's Magic Bag 164 are provided by panel light source 188 that is housed in curved panel subpart 164. Light source 188 may be a diffused yellow LED flood light that is electrically connected to circuit 198. The light source 188 may shine on the front side of a portion of the decorative scene 145, such as Santa's 162 face. As such, the panel light source 188 may provide the appearance of a magic glow emitting from Santa's Magic Bag 164 or onto Santa's face 162. The light effects provided by the light source 188 may cycle with fade effects. As described in more detail below in connection with FIG. 6, the natural fade/flicker lighting of panel light sources 186 and 188 may be controlled by a programmable controller 208.

Still referring to FIG. 5, some or all of the panel light sources 186 may be disposed rearwardly of the primary panel subpart 200 inside a light housing 202. The light housing 202 may be fixedly attached to the rear of the primary panel 200 so as to align the three panel light sources 186 with the two candles 160 and the fireplace 168 elements of the decorative scene 145 (FIG. 1). The light housing 202 may serve to block light of the panel light sources 186 from passing through the rear portion 180, thereby preventing the panel light sources 186 from interfering with light-piping or backlighting effects provided by the other light sources 182 and 190. In some embodiments, both the primary panel 200 and the light housing 202 may contain an aperture through which a wire 189 may be routed to electrically connect with embedded light source 188 proximal to the curved panel subpart 164.

Figure 6:
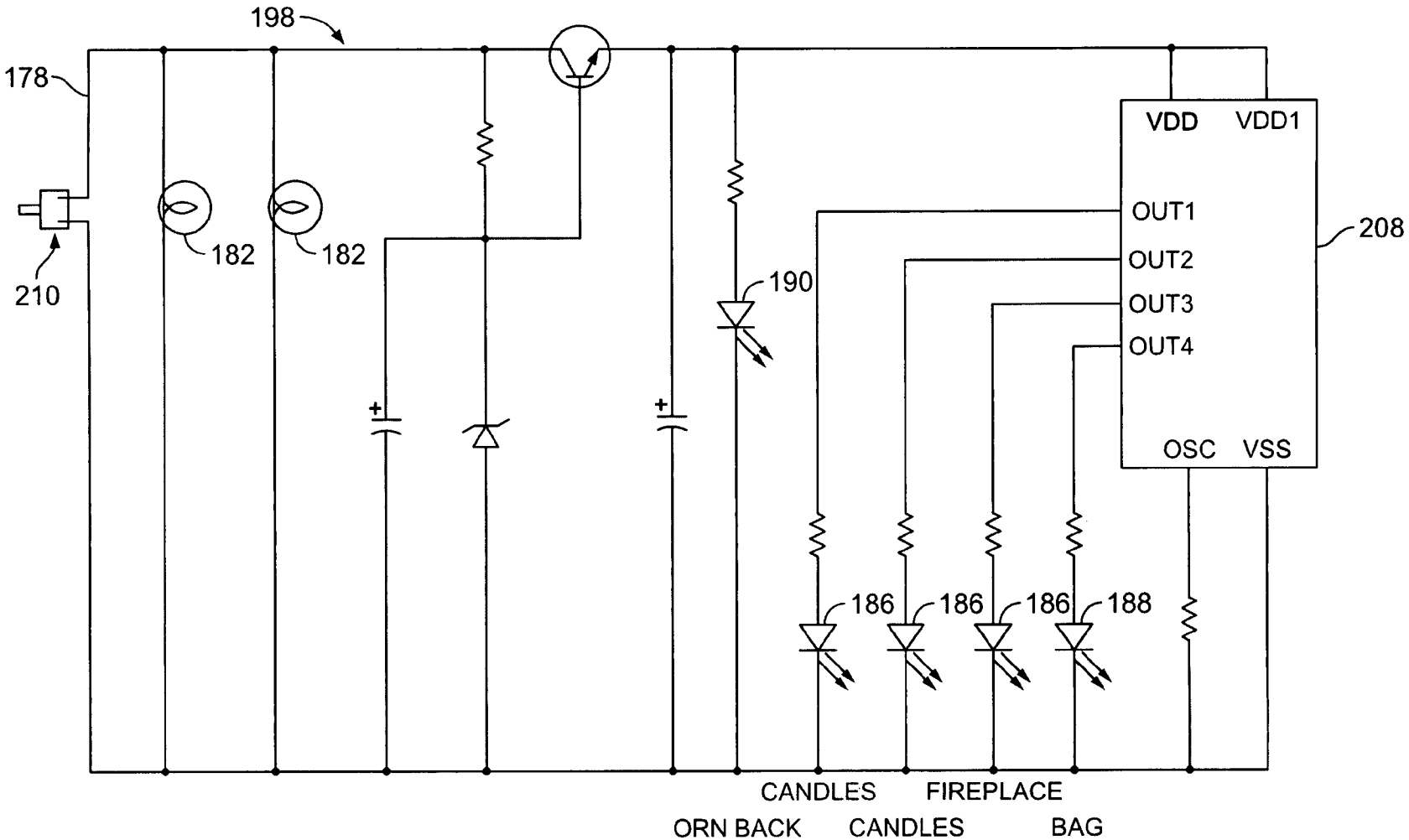
FIG. 6 is a schematic diagram of an exemplary circuit for the device of FIG. 1.

Referring now to FIG. 6, one or more of the light sources 182, 186, 188, and 190 may be electrically connected to a circuit 198. The circuit 198, which may be at least partially embodied as a printed circuit board having components mounted thereto (see FIG. 5), may include a programmable controller 208 to independently illuminate and dim any combination of the internal light sources 182, 186, 188, and 190. In this embodiment, a power source 210 supplies the circuit 198 with power. The power source may be, for example, a DC battery power supply, an AC-DC adapter, or other DC power source. As previously described in connection with FIGS. 2-5, the power source may be connected to the circuit 198 via the wire 178. At least one of the light sources may be powered without the use of the controller 208. For example, the light sources 182 and 190 may be constantly illuminated when power is provided to the circuit 198. In such embodiments, the light sources 182 and 190 are not controlled by signals from the controller 208. In other embodiments (not shown in FIG. 6), the illumination of light sources 182 and 190 may be controlled by the controller 208.

The controller 208 may include multiple outputs to individually control one or more light sources. For example, as shown, the controller 208 includes outputs (OUT1, OUT2, OUT3, and OUT4) to control the panel light sources 186 and 188 for each of the candles 160, the fireplace 168, and Santa's Magic Bag 164. The controller may be capable of being programmed to vary the voltage to the light sources 186 and 188. Based on a time variation in the voltage to each of the outputs (OUT1, OUT2, OUT3, and OUT4), the controller 208 may cause the light sources 186 and 188 to individually power on, power off, flicker, fade, or maintain varying levels of brightness. In some circumstances, each of the light sources 186, 188, and 190 may be connected to a timer output (OSC) of the controller 208 which may enable simultaneous power on, power off, flicker, fade, or other lighting effects by varying the voltage on output (OSC). The voltage on the outputs (OUT1, OUT2, OUT3, OUT4 and OSC) of the controller 208 may be varied over time to illuminate the light sources 186, 188, and 190 in a particular pattern or at predetermined time intervals. For example, the controller 208 may store one or more time-varying voltage patterns for each output that may either individually or simultaneously, for example, be repeated or randomly selected.

In some embodiments, at least a portion of the circuit 198 may be at least partially formed on a printed circuit board that is configured to fit within the body of the ornament 140 (as shown in FIG. 5). The programmable controller 208 may be a commercially available electronic device or a more complex module, depending upon the sequencing of control signals and the technology used to for the internal light sources. For example, in some implementations, the programmable controller 208 may comprise a voice synthesizer device capable of storing one or more channels of data that may be output as time-varying voltage waveforms.

Figure 7:
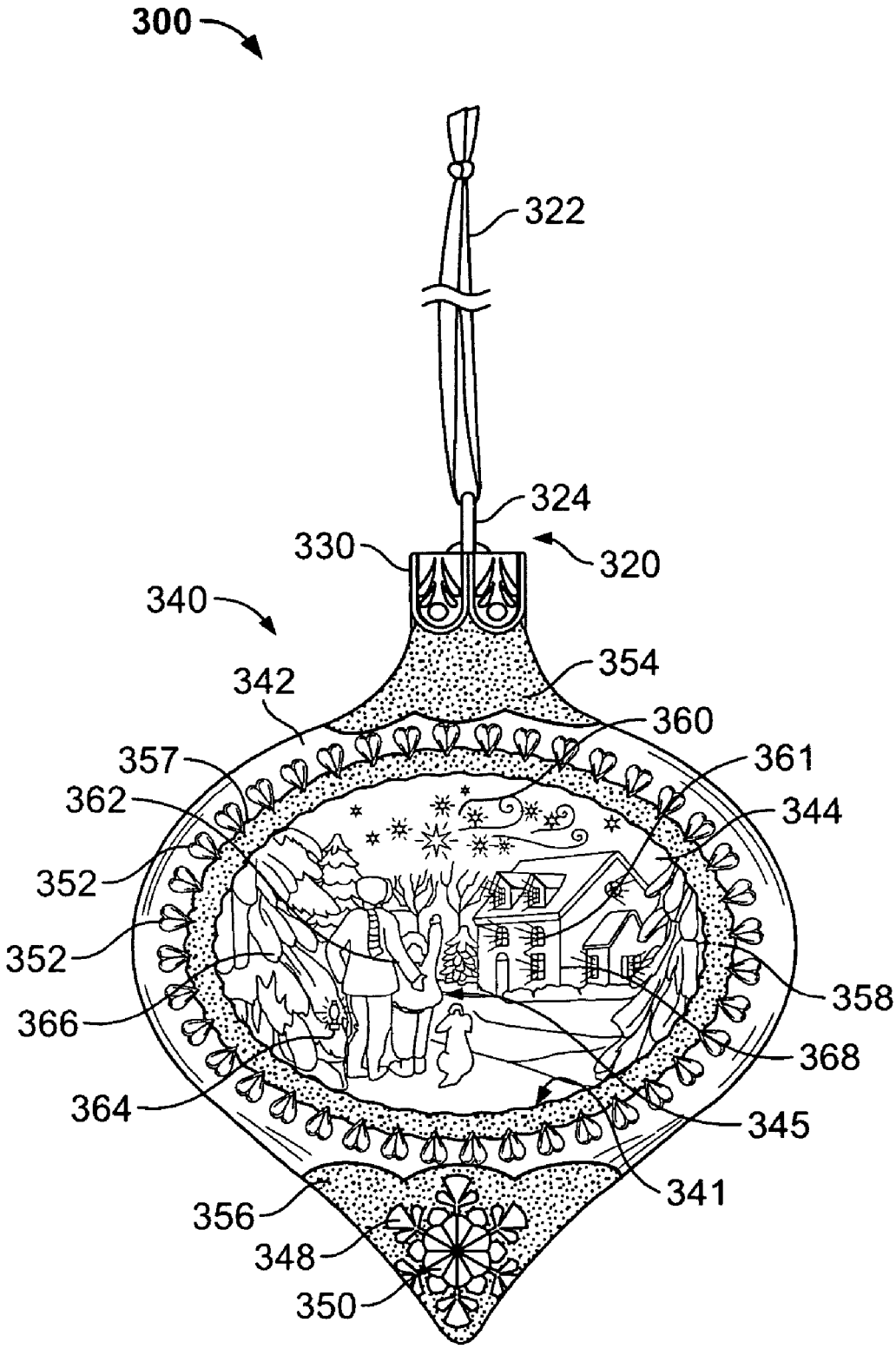
FIG. 7 is a front view of a decoration device in accordance with some embodiments of the invention.

Referring to FIG. 7, some embodiments of a decoration device 300 may include an ornament structure 340 having an alternative shape and design appearance. The ornament structure 340 may include a front portion 342, which may include one or more decorative elements that are configured to resemble patterns, characters, or words that may be associated with a particular season or holiday. In this embodiment, the decorative elements on the front portion 342 include a plurality of medium decorative snowflakes 346 (FIG. 8), a large decorative snowflake 348, a debossed faceted star 350, a plurality of embossed teardrops 352, and glitter patterns 354 and 356 that may be associated with the Christmas holiday. The front portion 342 may define an aperture 357 that provides viewability to an interior space 341 of the ornament structure 340. In some embodiments, the aperture 357 may include a decorative border 358, such as a scalloped oval frame.

The decoration device 300 may include an attachment mechanism 320, similar to the previously described embodiments. As such, the attachment mechanism 320 may releasably couple the ornament structure 340 to an external object, such as a hook on a wall, a doorknob, a railing, or a branch of a Christmas tree.

Still referring to FIG. 7, a decorative panel 344 may be disposed in the substantially hollow interior space 341 (FIG. 11) of the ornament structure 340. The panel 344 may include a decorative scene 345 disposed on a front side of the panel 344. Some portions of the scene 345, such as the lantern 364, house lights 361, stars 360, or the like, may resemble objects that shed light on other portions of the scene 345. In this embodiment, the decorative panel 344 is configured as a scene from Santa's visit on Christmas Eve and includes people 362, a lantern 364, snow covered trees 366, and a house 368.

Similar to some of the previously described embodiments, the panel 344 may include a curved surface to provide a three-dimensional scene. In such circumstances, the panel 344 may comprise a plurality of panel scene subparts in which at least one of the subparts is curved to correspond to a decorative element of the scene 345. For example, the people 362 and the snow covered tress 366 may be curved panel subparts (while the primary panel subpart 400 is substantially noncurved and comprises the lighted house 361). As described in more detail below, the panel subparts 362, 366 and primary panel subpart 400 (also shown in FIG. 11) may be part of an assembly that includes lighting effects.

Figure 8:
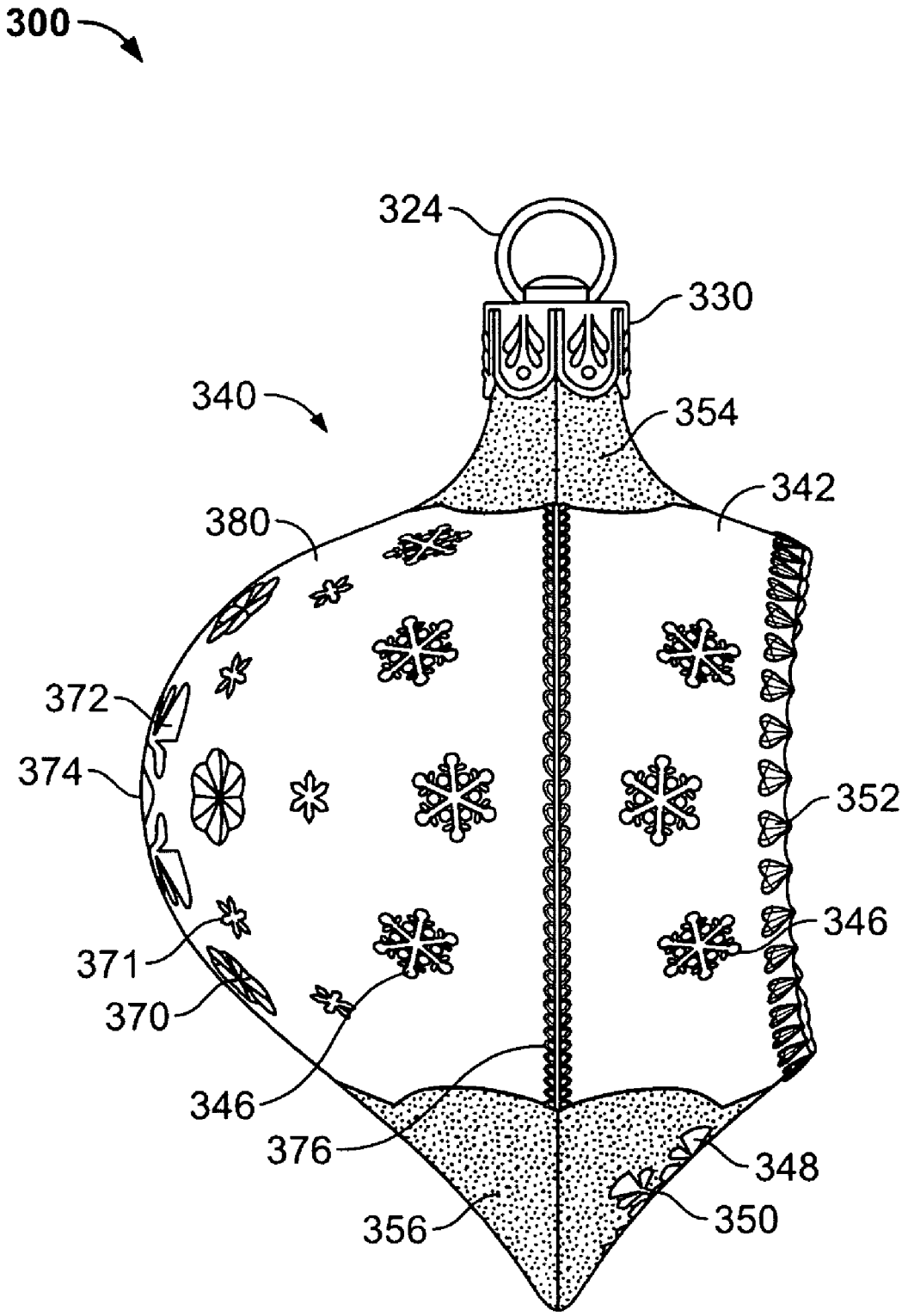
FIG. 8 is a cross-sectional side view of the decoration device of FIG. 7.
Figure 9:
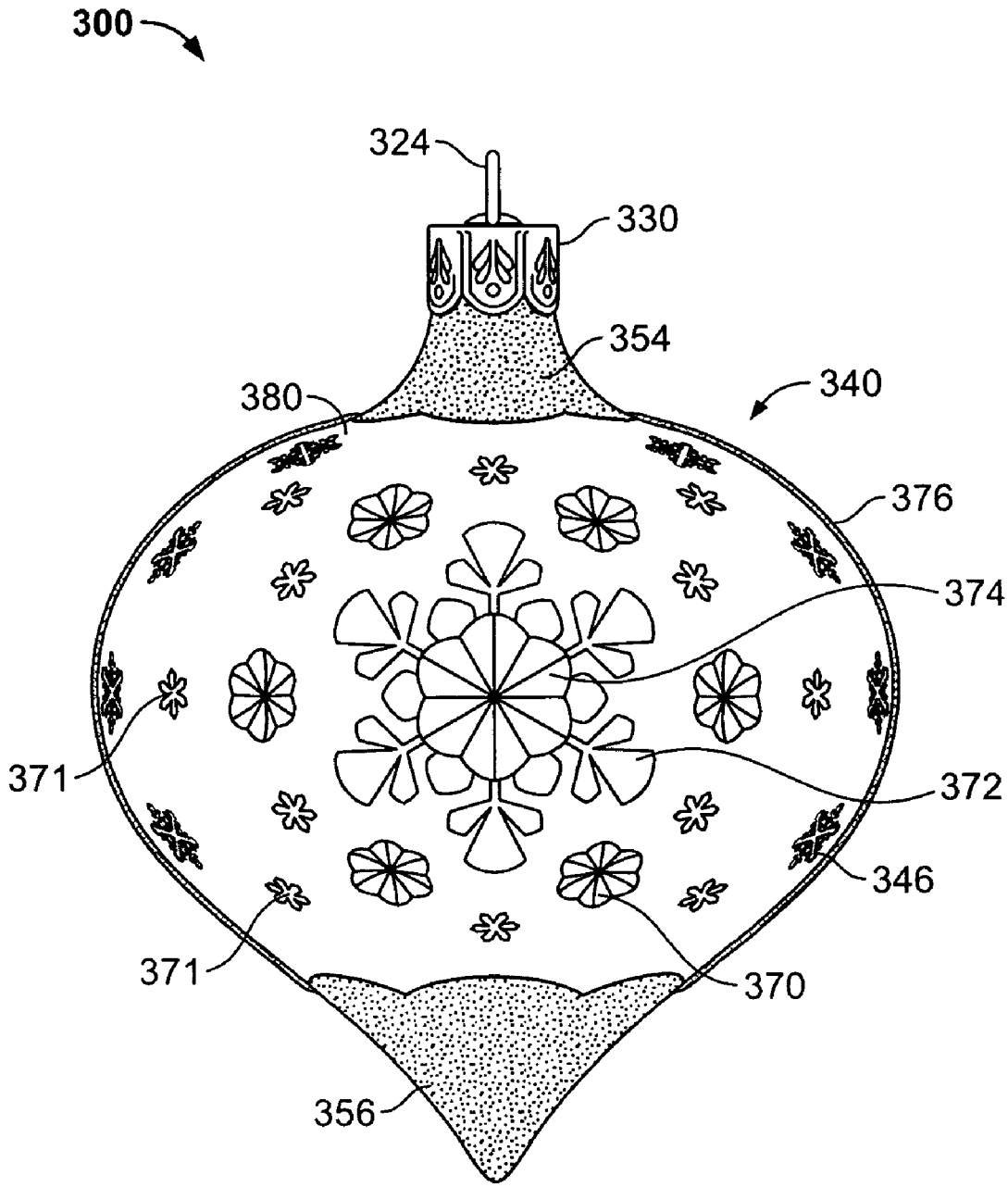
FIG. 9 is a sectional front view of a portion of the decoration device of FIG. 7.

Referring to FIGS. 8-9, the ornament structure 340 may include a rear portion 380 that is disposed opposite to the front portion 342. The rear portion 380 may include one or more decorative elements that are configured to resemble patterns, characters, or words that may be associated with a particular season or holiday. In this embodiment, the decorative elements on the rear portion 380 include a plurality of medium decorative snowflakes 346, a plurality of small debossed faceted snowflakes 370, small decorative snowflakes 371, a large decorative snowflake 372, a large debossed faceted snowflake 374, and the previously mentioned glitter patterns 354 and 356 that may be associated with Christmas.

Figure 11:
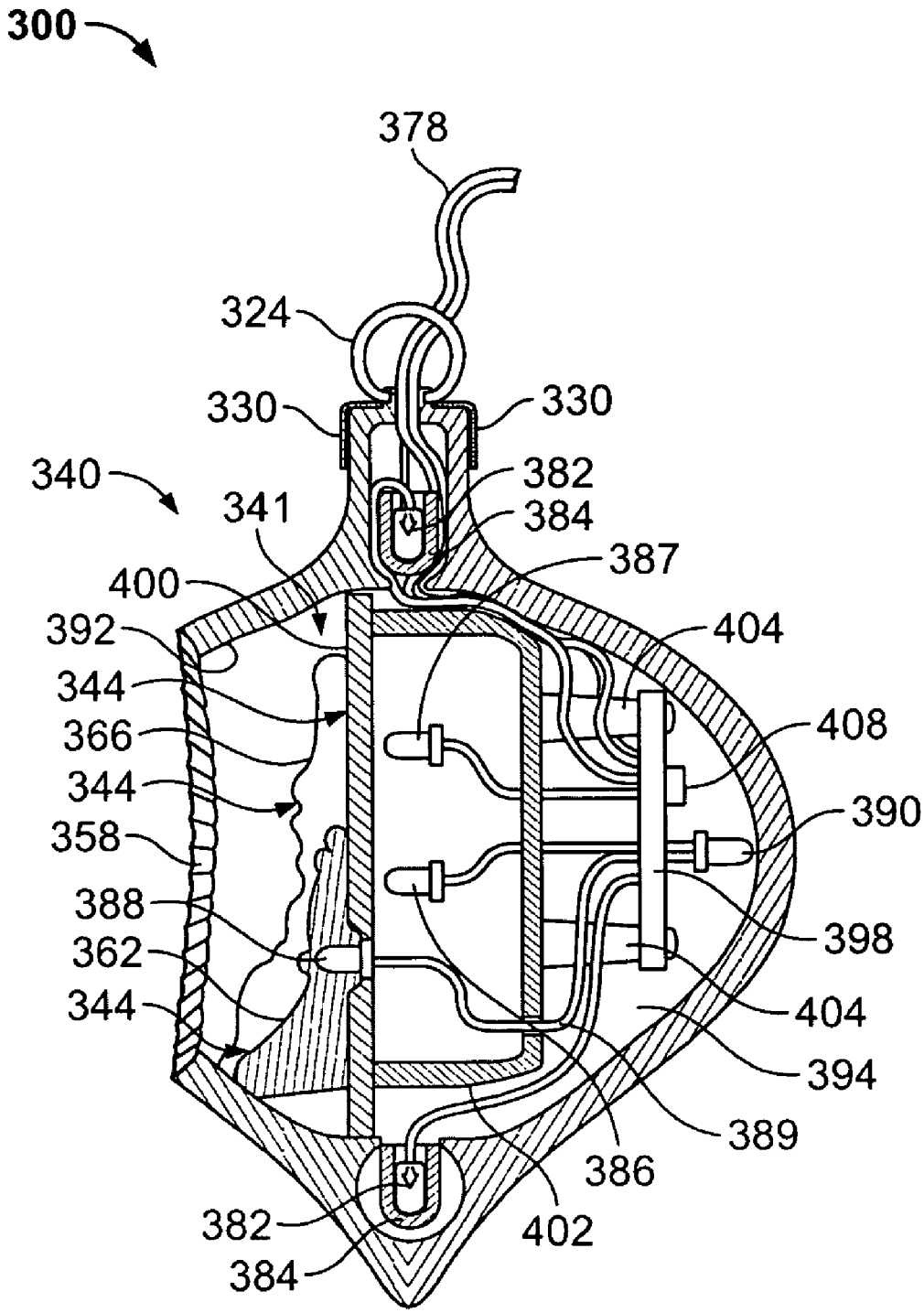
FIG. 11 is a rear view of the decoration device of FIG. 7.

Similar to the embodiments described in connection with FIGS. 2-3, the ornament structure 340 shown in FIGS. 8-9 may be substantially hollow such that an internal space 341 is defined between the front portion 342 and the rear portion 380. One or more internal light sources 382, 386, 387, 388, and 390 may be disposed at least partially in the internal space 341 (as shown in FIG. 11). The ornament structure 340 may comprise a substantially transparent or translucent, light transmissive, and flame resistant polymer material. Additionally, the ornament structure 340 may employ light from the internal light sources 382 and 390 to provide lighting effects such as light-piping, edge lighting, and backlighting to the surfaces and surface elements of the ornament structure 340.

Figure 10:
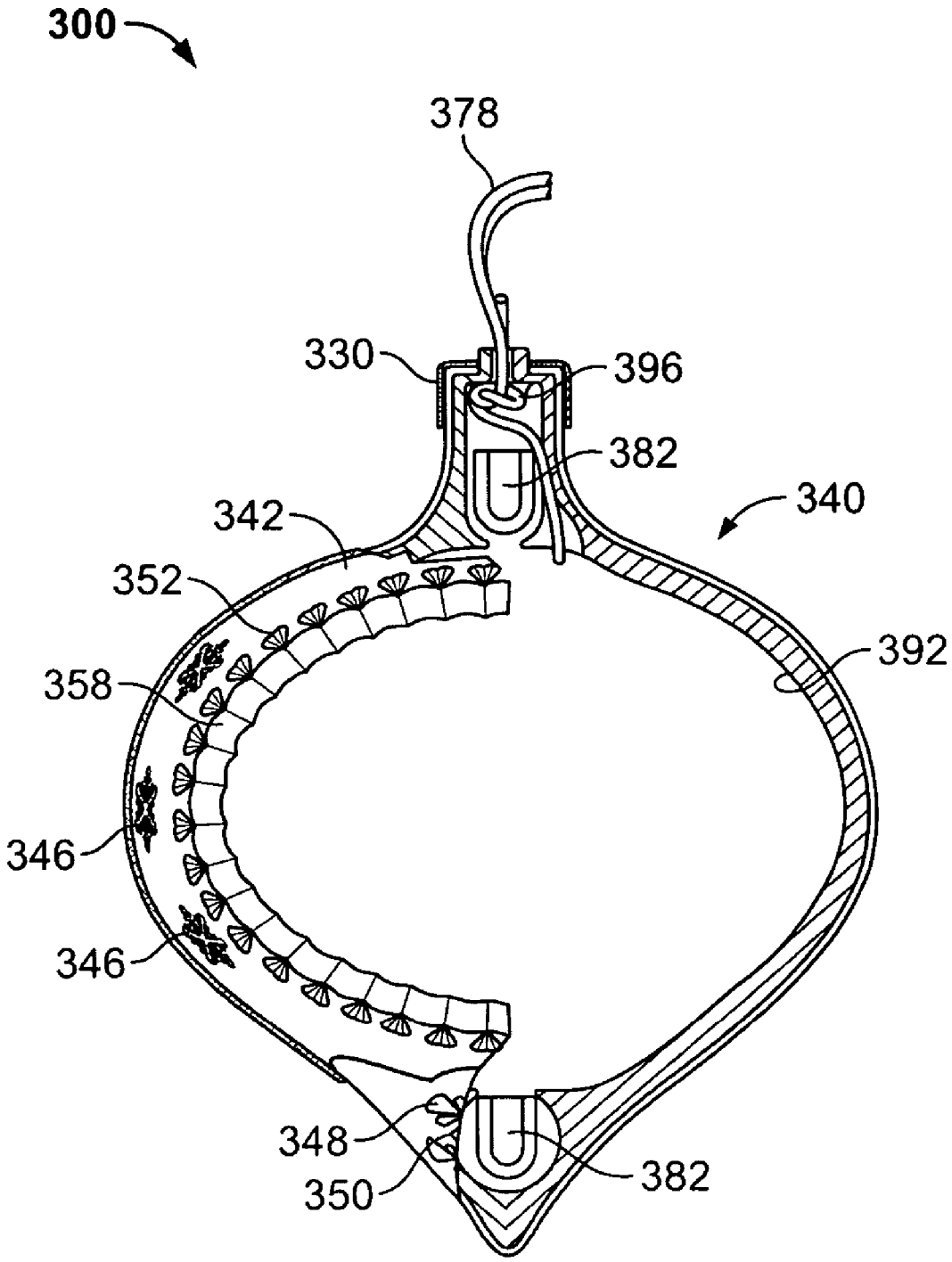
FIG. 10 is a side view of the decoration device of FIG. 7.

Referring now to FIGS. 10-11, in this embodiment the body light sources 382 may comprise high-brightness incandescent lamps disposed in cavities proximal to the top and bottom of the ornament structure 340. The incandescent lamps 382 may have a brightness of at least 0.25 MSCP (Mean Spherical Candlepower) and may provide a constant source of light when power is supplied to the decoration 300. The lamps 382 may have lamp covers 384 that comprise a substantially transparent and flame resistant polycarbonate material. Similar to the previously described embodiments, the light supplied by the lamps 382 may create a glowing effect throughout the outer surface of the ornament structure 340 and provide edge lighting effects to a plurality of the design elements (e.g., 346, 348, 350, 352, 358, 370, 371, 372, and 374).

Referring to FIG. 11, the illumination of particular design elements of the decorative panel 344 may be accomplished using constantly powered or synchronized lighting effects (e.g., power on, power off, flicker, fade, varying colors, or varying levels of brightness). In this embodiment, the decorative panel 344 incorporates three light sources (one of panel light source 386, one of panel light source 387, and one of panel light source 388) that may be placed inside or behind the panel subparts 362, 366, and 400. Similar to the previously described embodiments, portions of the panel 344 that are aligned with nighttime stars 360 and the houselights 361 may be substantially transparent or translucent while the remaining portions of the panel 344 may be opaque. As such, the light from the panel sources 386 and 387 may transmit through the substantially transparent or translucent portions to provide a realistic lighting effect to the stars 360 and the house lights 361 of the panel scene 345. For example, the light from the panel light sources 386, 387 may pass through the substantially transparent or translucent portions proximal the nighttime stars 360 and the houselights 361 to shine upon, for example, the human characters 362, but the light from the panel light sources 386, 387 will not necessarily pass through the opaque portions of the panel 344 to transmit through the human characters 362.

As shown in FIGS. 7 and 11, the light from the panel light sources 386 and 387 is directed towards the stars 360 and the house lights 361 of the decorative scene 345. In such circumstances, the stars 360 and the house lights 361 have the appearance of emitting light that illuminates other portions of the decorative scene 345. To provide a realistic appearance of starlight or house lights, the panel sources 386 and 387 may comprise two diffused yellow LEDs that are electrically connected to circuit 398. The light effects of panel sources 386 and 387 may be controlled to simulate the random twinkle and the glow of light from the stars 360 and from the house lights 361.

Although panel light sources 386 and 387 may be disposed rearwardly of the primary panel 400, at least one panel light source 388 may be housed inside or between one or more panel subparts 362, 364, and 400. For example, the light effects of the lantern 364 are provided by panel light source 388 that is housed in curved panel subpart 362. Light source 388 may be a diffused yellow LED flood light that is electrically connected to circuit 398. The light source 388 may illuminate elements such as the people with the dog 362, and the snow covered trees 366.

Still referring to FIG. 11, some or all of the panel light sources 386 and 387 may be disposed rearwardly of the primary panel subpart 400 inside a light housing 402. The light housing 402 may be fixedly attached to the rear of the primary panel 400 so as to align the two panel light sources 386 and 387 behind the primary panel 400 proximal to the stars 360 and house 368 elements of the decorative scene 345 (FIG. 7). In some embodiments, both the primary panel 400 and the light housing 402 may contain an aperture through which a wire 389 may be routed to electrically connect with embedded light source 388 proximal to the curved panel subpart 364.

Figure 12:
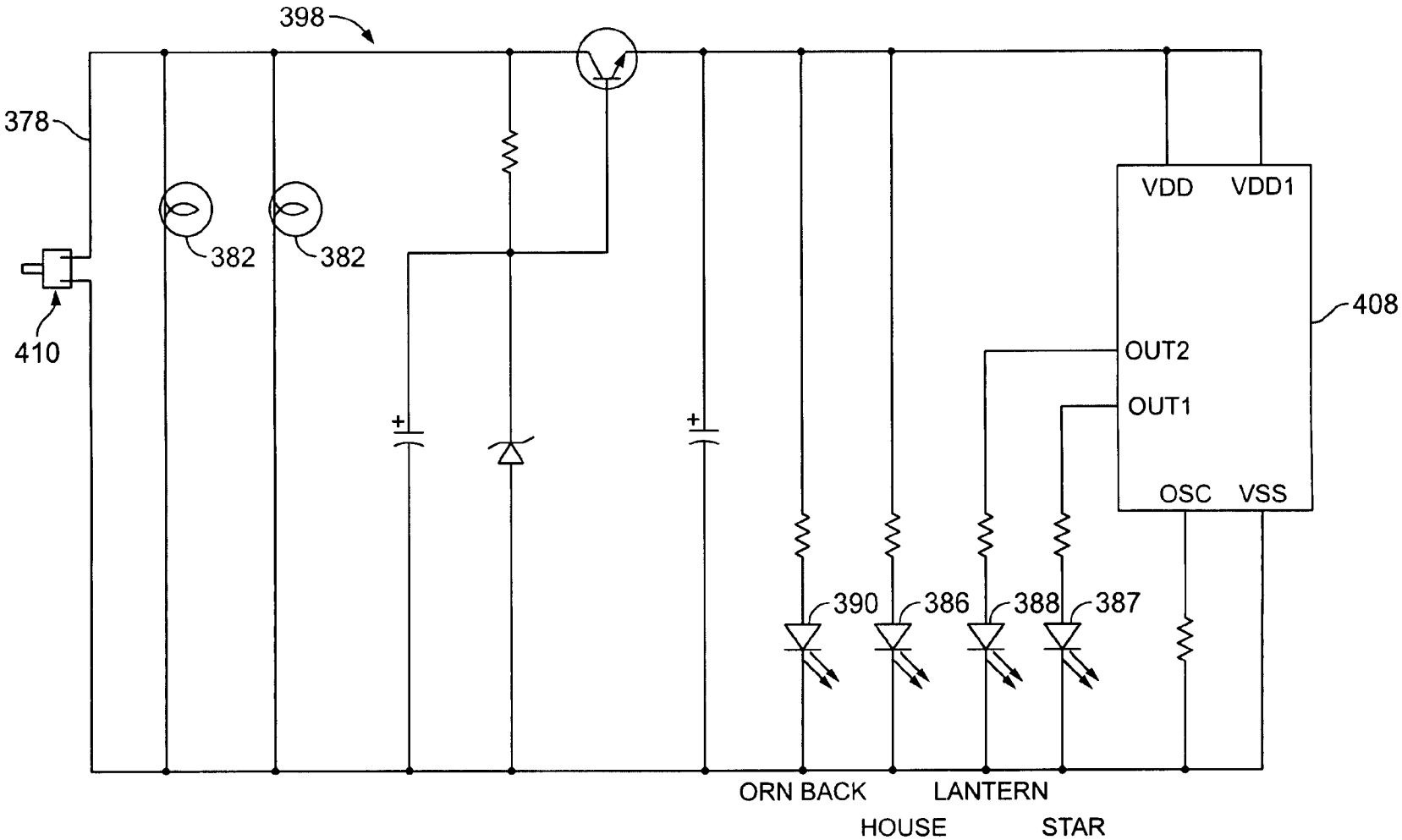
FIG. 12 is a schematic diagram of an exemplary circuit for the device of FIG. 7.

Referring now to FIG. 12, one or more of the light sources 382, 386, 387, 388, and 390 may be electrically connected to a circuit 398. As previously described, the circuit 398, may be at least partially embodied as a printed circuit board configured to fit within the body of the ornament 340 and having components mounted thereto (see FIG. 11). The circuit 398, may include a programmable controller 408 such as a commercially available electronic device or a more complex module. The programmable controller 408 may independently illuminate and dim any combination of the internal light sources 382, 386, 387, 388, and 390. Similar to the previously described embodiments, the controller 408 may include multiple outputs to individually control one or more light sources.

Referring now to FIGS. 13-18, some embodiments of a decoration device 500 may include an ornament structure 540 having yet another shape and design appearance. Similar to the previously described embodiments, the ornament structure 540 may include a front portion 542 and a rear portion 580, both of which may include one or more decorative elements that are configured to resemble patterns, characters, or words that may be associated with a particular season or holiday. In this embodiment, the decorative elements may include a plurality of small decorative snowflakes 546 (FIG. 14), a large decorative snowflake 548, a debossed faceted star 550, a plurality of embossed florets 552, a plurality of small debossed faceted stars 570, large decorative snowflake 572, a large debossed faceted star 574, and glitter patterns 554 and 556 that may be associated with the Christmas holiday. The front portion 542 may define an aperture 557 that provides viewability to an interior space 541 of the ornament structure 540. As previously described, the aperture 557 may include a decorative border 558, such as a scalloped oval frame, that encircles the decorative border 558. The decoration device 500 may also include an attachment mechanism 520 to releasably couple the ornament structure 540 to an external object, such as a hook on a wall, a doorknob, a railing, or a branch of a Christmas tree.

Figure 13:
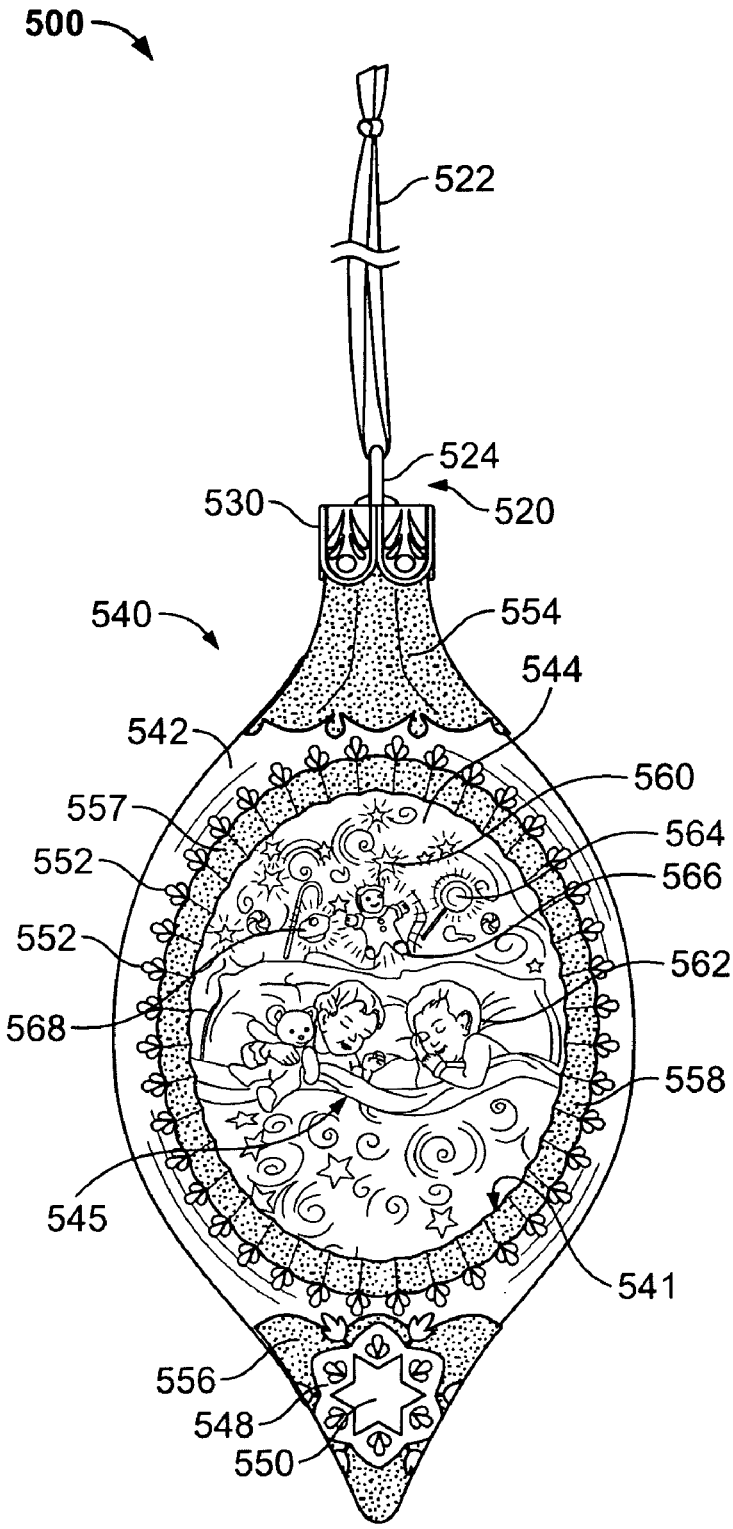
FIG. 13 is a front view of a decoration device in accordance with some embodiments of the invention.
Figure 14:
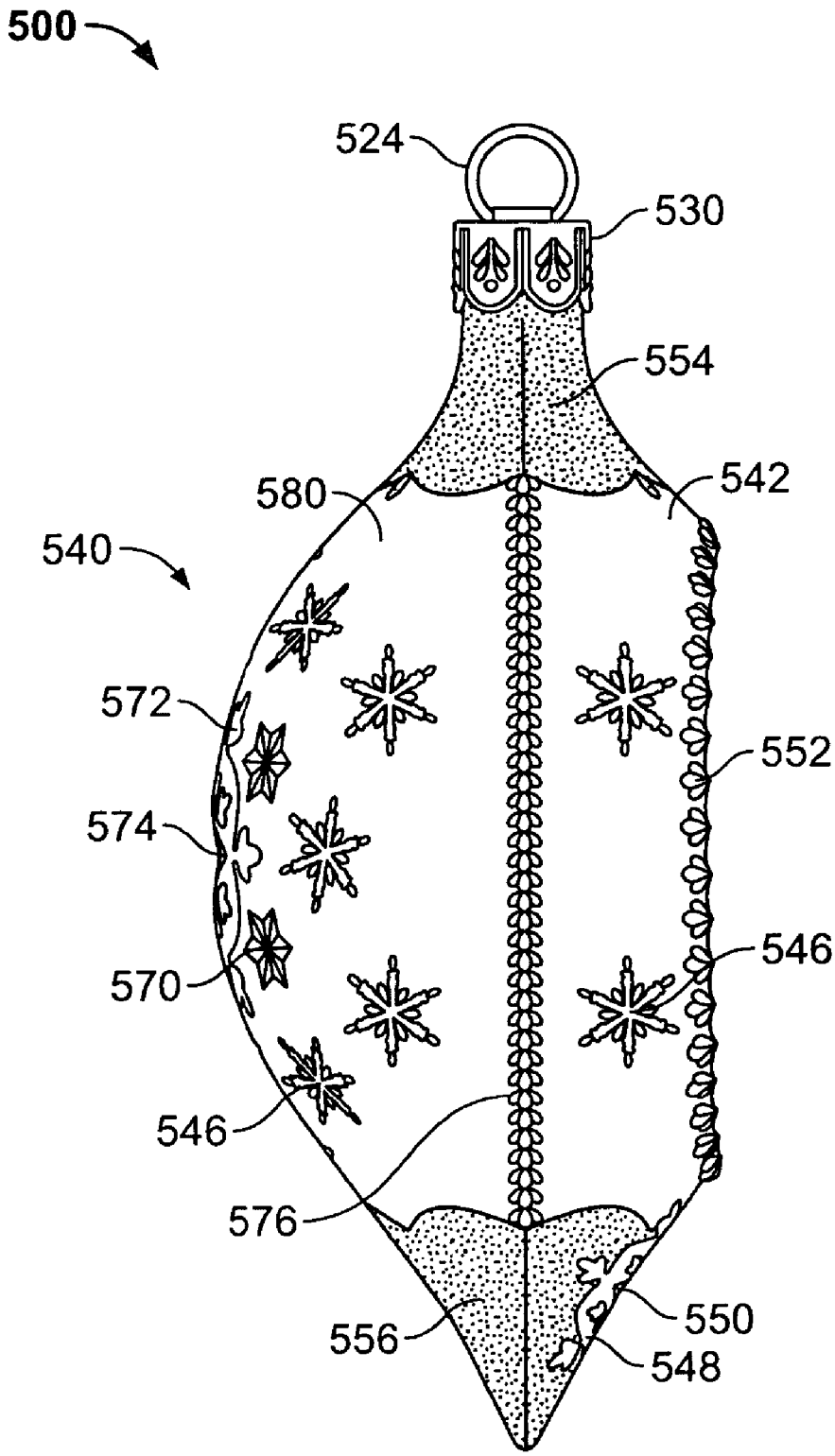
FIG. 14 is a cross-sectional side view of the decoration device of FIG. 13.
Figure 15:
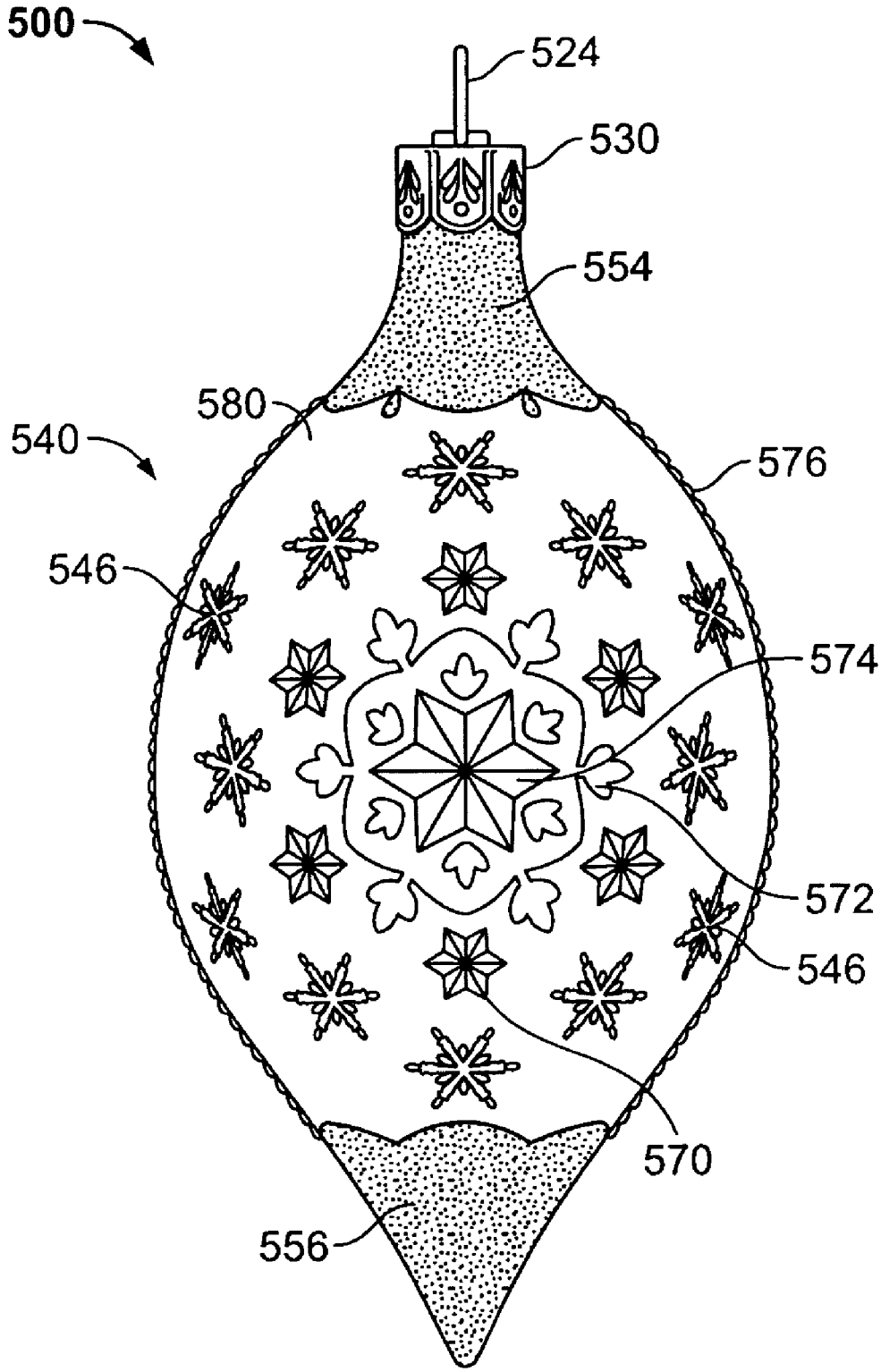
FIG. 15 is a sectional front view of a portion of the decoration device of FIG. 13.
Figure 16:
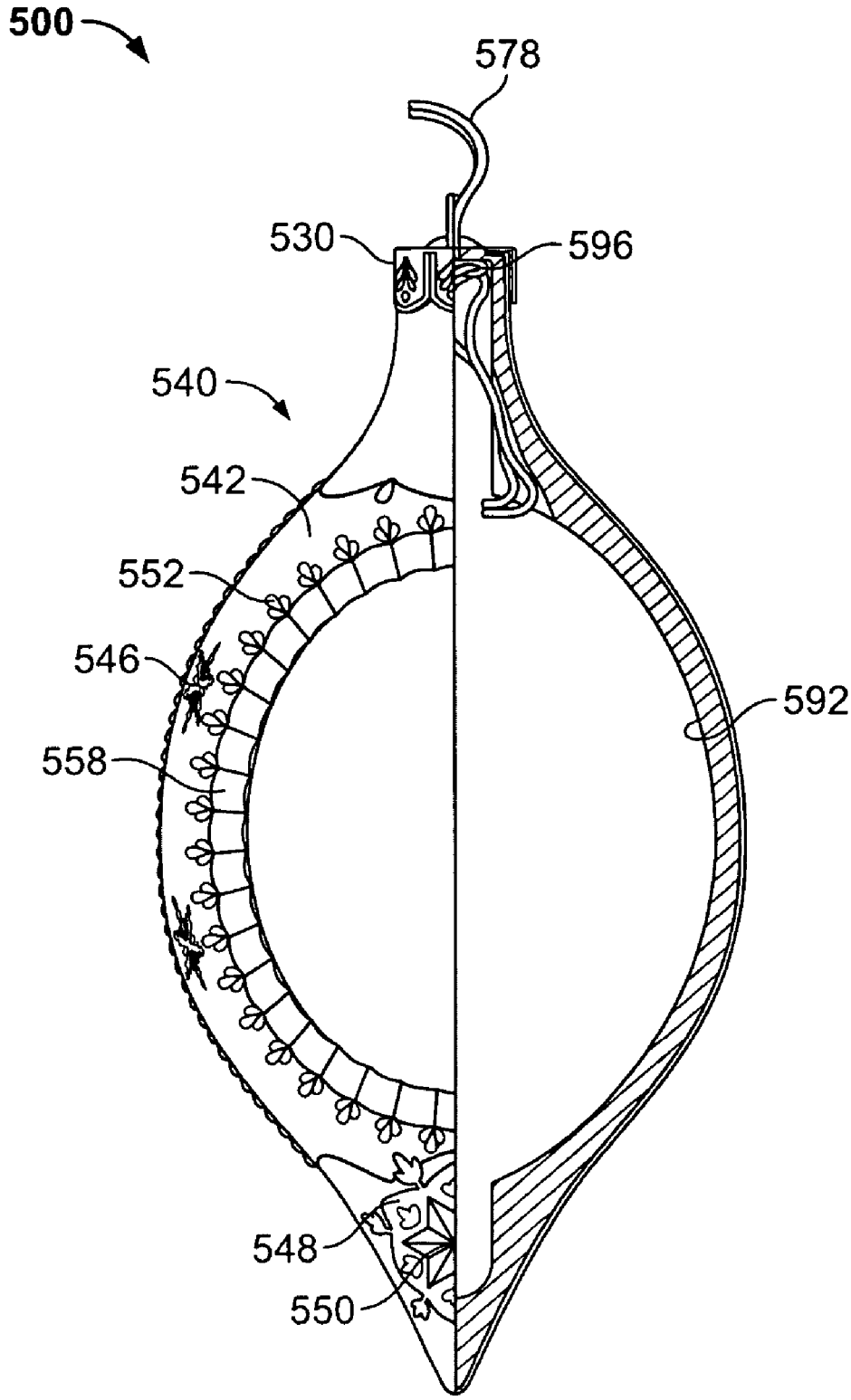
FIG. 16 is a side view of the decoration device of FIG. 13.
Figure 17:
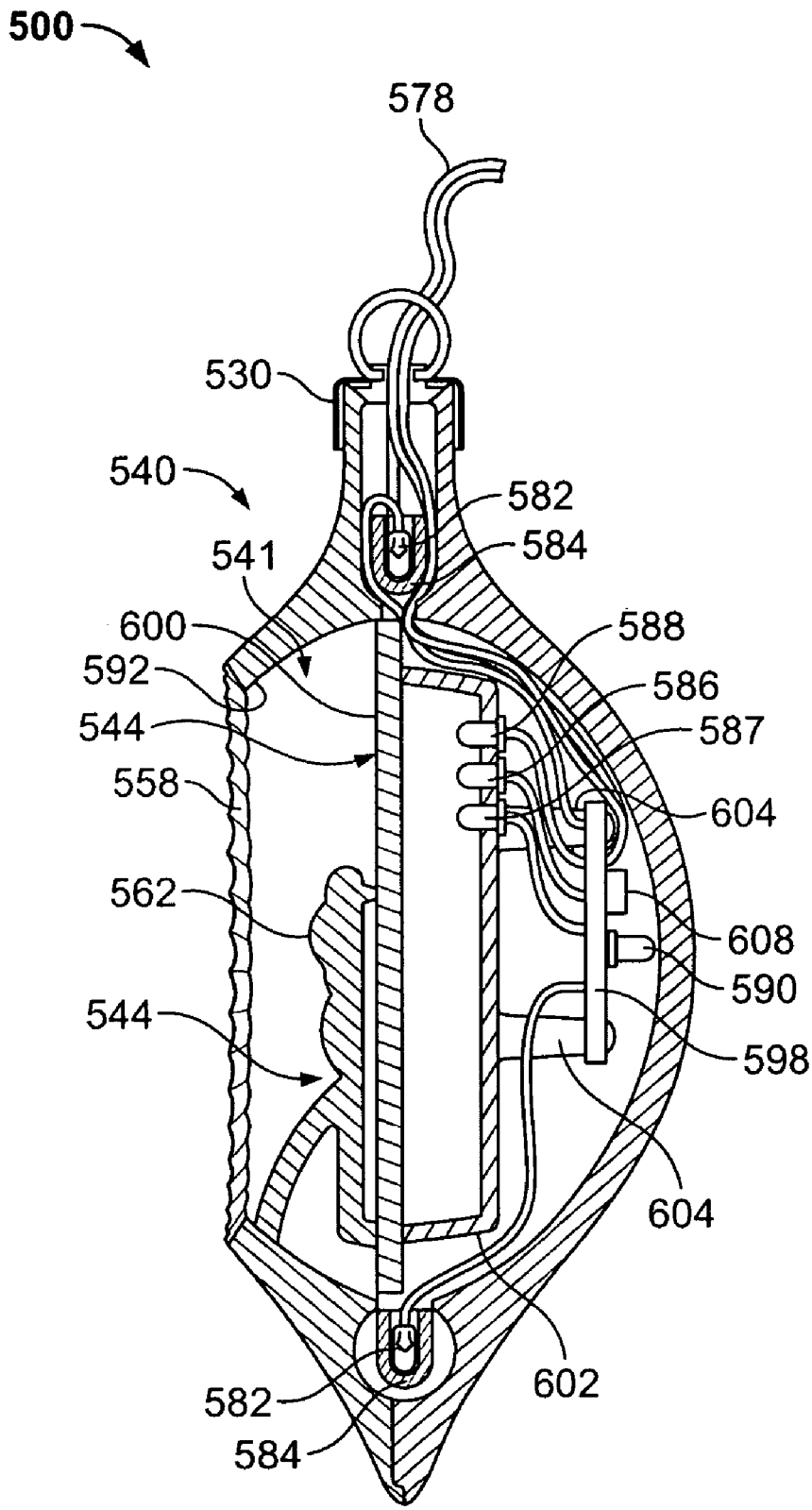
FIG. 17 is a rear view of the decoration device of FIG. 13.

Referring to FIGS. 13 and 17, a decorative panel 544 may be disposed in the substantially hollow interior space 541 (FIG. 17) of the ornament structure 540. The panel 544 may include a decorative scene 545 disposed on a front side of the panel 544. Some portions of the scene 545, such as the lollipop 564, cupcake 568, gingerbread man 566, stars 560, or the like, may resemble objects that shed light on other portions of the scene 545. In this embodiment, the decorative panel 544 is configured as a scene from children asleep and dreaming on Christmas Eve. Similar to some of the previously described embodiments, the panel 544 may include a curved surface to provide a three-dimensional scene. In such circumstances, the panel 544 may comprise a plurality of panel scene subparts in which at least one of the subparts is curved to correspond to a decorative element of the scene 545. For example, the sleeping children in bed 562 may comprise a curved panel subpart, while the primary panel subpart 600 is substantially flat. The curved panel subpart 562 may be part of an assembly that includes lighting effects (described in more detail below).

Similar to the embodiments described in connection with FIGS. 8-9, one or more internal light sources 582, 586, 587, 588, and 590 may be disposed at least partially in the internal space 541 (as shown in FIG. 17). The ornament structure 540 may comprise a substantially transparent or translucent light transmissive, and flame resistant polymer material. Additionally, the ornament structure 540 may employ light from the internal light sources 582 and 590 to provide lighting effects such as light-piping, edge lighting, and backlighting (as previously described).

In the embodiment depicted in FIG. 17, the body light sources 582 may comprise high-brightness incandescent lamps disposed in cavities proximal to the top and bottom of the ornament structure 540. Also, the lamps 582 may have lamp covers 584 that comprise a substantially transparent and flame resistant polycarbonate material. As previously described, the light supplied by the lamps 582 may create a glowing effect throughout the outer surface of the ornament structure 540 and provide edge-lighting effects to a plurality of the design elements (e.g., 546, 548, 550, 552, 558, 570, 572, and 574). As previously described, the backlighting for the large debossed faceted star 574 may be provided by the rear light source 590. The rear light source 590 may comprise a high brightness white LED that is electrically connected to the controller unit 608 of the circuit 598.

Referring to FIG. 17, the illumination of particular design elements of the decorative panel 544 may be accomplished using constantly powered or synchronized lighting effects (e.g., power on, power off, flicker, fade, varying colors, or varying levels of brightness). In this embodiment, the decorative panel 544 incorporates four light sources (two of panel light source 586, one of panel light source 587, and one of panel light source 588) that are placed behind the panel subparts 562 and 600. Similar to the previously described embodiments, portions of the panel 544 that are aligned with the nighttime stars 560, the lollipop 564, the gingerbread man 566, and the cupcake 568 may be substantially transparent or translucent while the remaining portions of the panel 544 may be opaque. As such, the light from the panel sources 586, 587 and 588 may transmit through the substantially transparent or translucent portions to provide a realistic lighting effect to the nighttime stars 560, the lollipop 564, the gingerbread man 566, and the cupcake 568 of the panel scene 545.

As shown in FIGS. 13 and 17, the light from the panel light sources 586, 587 and 588 may be substantially aligned with the stars 560, the lollipop 564, the gingerbread man 566, and the cupcake 568 of the decorative scene 545. In such circumstances, the stars 560, the lollipop 564, the gingerbread man 566, and the cupcake 568 have the appearance of emitting light that illuminates other portions (e.g., the children 562) of the decorative scene 545. To provide a realistic appearance the panel sources 586, 587 and 588 may comprise two diffused yellow LEDs, one diffused red LED, and one green LED, respectively, that are electrically connected to circuit 598. The light effects of panel sources 586, 587 and 588 may be controlled to simulate the random twinkle and the glow of light from the stars 560, the lollipop 564, the gingerbread man 566, and the cupcake 568.

Figure 18:
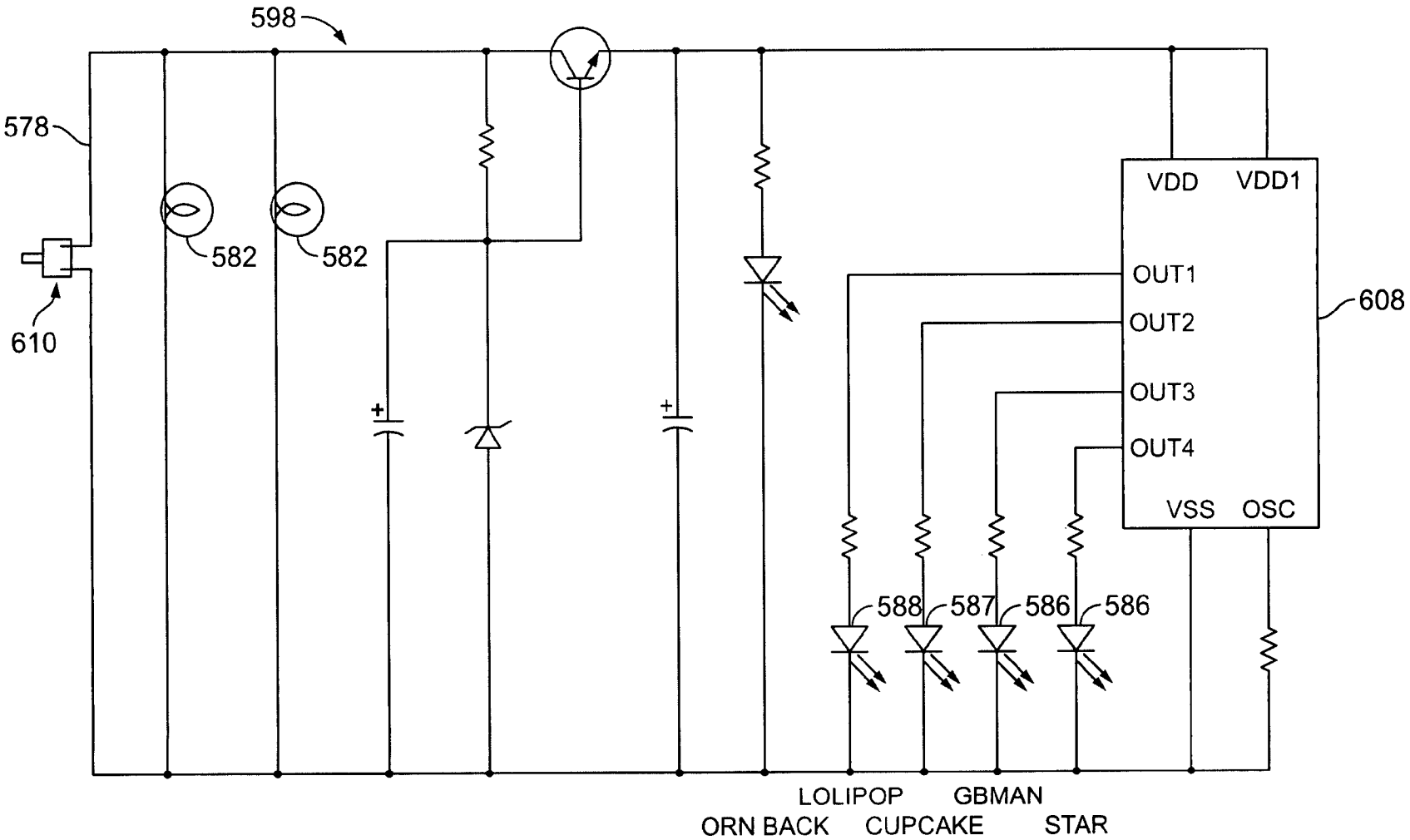
FIG. 18 is a schematic diagram of an exemplary circuit for the device of FIG. 13.

Referring now to FIG. 18, one or more of the light sources 582, 586, 587, 588, and 590 may be electrically connected to a circuit 598. Similar to previously described embodiments, the circuit 598 may be at least partially embodied as a printed circuit board configured to fit within the body of the ornament 540 and having components mounted thereto (refer to FIG. 17). The circuit 598, may include a programmable controller 608 such as a commercially available electronic device or a more complex module. The programmable controller 608 may independently illuminate and dim any combination of the internal light sources 582, 586, 587, 588, and 590. As previously described, the controller 608 may include multiple outputs to individually control one or more light sources.

In the embodiments shown in FIGS. 1, 7, and 13, a plurality of the decoration devices 100, 300, and 500 may be simultaneously displayed so that the individual scenes 145, 345, and 545 are related to one another. For example, the decoration devices 100, 300, and 500 may be mounted to a Christmas tree or a wall hook using their respective attachment mechanisms. In such circumstances, a viewer may contemporaneously view the scenes 145, 345, and 545 of the decoration devices 100, 300, and 500. The scenes 145, 345, and 545 may collectively tell a story associated with a particular holiday or season. In the embodiments shown in FIGS. 1, 7, and 13, the three scenes 145, 345, and 545 tell a story of Santa's visit on Christmas Eve. The decoration devices 100, 300, and 500 may be displayed in a particular order to show the storyline. For example, the scene 345 (FIG. 7) shows a scene in which a child is watching the nighttime sky for Santa's sleigh, the scene 545 shows a scene in which children are dreaming in their bed, and the scene 145 shows a scene in which Santa finally visits the house.

A number of embodiments of the invention have been described. Nevertheless, it will be understood that various modifications may be made without departing from the spirit and scope of the invention. For example, the decorative panel (e.g., 144, 344, 544) may include a decorative scene other than the scenes (e.g., 145, 345, 545) shown in FIGS. 1, 7, and 13, such as Elves in Santa's Workshop, Reindeer moving through the sky, or the like. Also, the decorative scene may include a theme related to a holiday or season other than the Christmas holiday, for example, the Spring season, the Halloween holiday, or the like. In another example, a plurality of decoration devices may have different scenes that collectively provide a different story line. For instance, some embodiments of decoration devices may tell a story associated with the Chanukah celebration in which a special oil lamp remained lit for eight days even though the fuel oil was only sufficient for one day. Accordingly, other embodiments are within the scope of the following claims.

What is claimed is:

1. A decoration system, comprising:

a first decoration device including:

an ornament structure having an opening through which an interior space of the ornament structure is viewable, a first panel disposed in the interior space, the first panel having a first decorative scene displayed on a front side of the first panel such that the first decorative scene is viewable through the opening, the first panel further having at least one substantially opaque portion aligned with the first decorative scene and at least one substantially transparent or translucent portion aligned with the first decorative scene, and a first light source disposed rearwardly of the first panel such that light emitted from the first light source is viewable through the substantially transparent or translucent portion of the first panel and through the opening of the ornament structure; and a second decoration device a second ornament structure that is separate from the first decoration device, the second decoration device including a second panel having a second decorative scene that is different from the first decorative scene, wherein the first and second decorative scenes collectively display at least a portion of a storyline associated with a holiday or season.

2. The system of claim 1, wherein the first and second decorative scenes collectively display at least a portion of a storyline associated with the Christmas holiday.

3. The system of claim 2, further comprising a third decoration device a third ornament structure that is separate from the first decoration device, the third decoration device including a third panel disposed having a third decorative scene that is different from the first and second decorative scenes, wherein the first, second, and third decorative scenes collectively display at least a portion of a storyline associated with a holiday or season.

4. The system of claim 1, wherein at least the first panel includes a curved panel subpart to provide three-dimensional scene.

5. The system of claim 1, wherein at least the first light source is electrically coupled to a programmable controller so that the light source provides fade or flicker lighting effects.

6. The system of claim 1, wherein the ornament structure of the first decoration device comprises a polymer material.

7. The system of claim 6, further comprising a body light source that is disposed adjacent to the ornament structure of the first decoration device such light emitted from the body light source is transmitted through the polymer material to provide a light-piping effect to the ornament structure.

8. A decoration device, comprising:

an ornament structure having an opening through which an interior space of the ornament structure is viewable, wherein the ornament structure comprises a polymer material and comprises a decorative shape formed in the polymer material so that the decorative shape is disposed on an outer surface of the ornament structure;

a panel disposed in the interior space, the panel having a decorative scene displayed on a front side of the panel such that the decorative scene is viewable through the opening, the panel further having at least one substantially opaque portion aligned with the decorative scene and at least one substantially transparent or translucent portion aligned with the decorative scene;

at least one light source disposed rearwardly of the panel such that light emitted from the light source is viewable through the substantially transparent or translucent portion of the panel and through the opening of the ornament structure; and a second light source disposed in the interior space of the ornament structure and proximal to the decorative shape formed in the polymer material such that light emitted from the second light source provides a back-lighting effect to the decorative shape.

9. The device of claim 8, wherein the panel includes a curved panel subpart to provide three-dimensional scene.

10. The device of claim 8, wherein the decorative scene includes a scene element having the appearance of a light source, the substantially transparent or translucent portion being aligned with the scene element so that the scene element has the appearance of emitting light that illuminates other portions of the decorative scene.

11. The device of claim 10, wherein the scene element is a fireplace image, the substantially transparent or translucent portion being aligned with the fireplace image of the scene element to provide an appearance of a lighted fireplace in the decorative scene.

12. The device of claim 10, wherein the scene element is a candle image, the substantially transparent or translucent portion being aligned with the candle image of the scene element to provide an appearance of a lighted candle in the decorative scene.

13. The device of claim 10, wherein the scene element is a star image, the substantially transparent or translucent portion being aligned with the star image of the scene element to provide an appearance of a lighted star in the decorative scene.

14. The device of claim 10, wherein the at least one light source is electrically coupled to a programmable controller so that the light source provides fade or flicker lighting effects.

15. The device of claim 8, further comprising a third light source that is disposed adjacent to the ornament structure such that light emitted from the third light source is transmitted through the polymer material to provide a light-piping effect to the ornament structure.

16. A decoration device, comprising:

an ornament structure having an opening through which an interior space of the ornament structure is viewable;

a panel disposed in the interior space, the panel having a decorative scene displayed on a front side of the panel such that the decorative scene is viewable through the opening, the panel further having at least one substantially opaque portion aligned with the decorative scene and at least one substantially transparent or translucent portion aligned with the decorative scene; and at least one light source disposed rearwardly of the panel such that light emitted from the light source is viewable through the substantially transparent or translucent portion of the panel and through the opening of the ornament structure, wherein the decorative scene includes a scene element having the appearance of a light source, the substantially transparent or translucent portion being aligned with the scene element so that the scene element has the appearance of emitting light that illuminates other portions of the decorative scene.

17. The device of claim 16, wherein the panel includes a curved panel subpart to provide three-dimensional scene.

18. The device of claim 16, wherein the scene element is a fireplace image, the substantially transparent or translucent portion being aligned with the fireplace image of the scene element to provide an appearance of a lighted fireplace in the decorative scene.

19. The device of claim 16, wherein the scene element is a candle image, the substantially transparent or translucent portion being aligned with the candle image of the scene element to provide an appearance of a lighted candle in the decorative scene.

20. The device of claim 16, wherein the scene element is a star image, the substantially transparent or translucent portion being aligned with the star image of the scene element to provide an appearance of a lighted star in the decorative scene.

21. The device of claim 16, wherein the at least one light source is electrically coupled to a programmable controller so that the light source provides fade or flicker lighting effects.

22. The device of claim 16, wherein the ornament structure comprises a polymer material.

23. The device of claim 22, further comprising a second light source that is disposed adjacent to the ornament structure such that light emitted from the second light source is transmitted through the polymer material to provide a light-piping effect to the ornament structure.

24. The device of claim 22, wherein the ornament structure comprises a decorative shape formed in the polymer material so that the decorative shape is disposed on an outer surface of the ornament structure.

25. The device of claim 24, further comprising a second light source disposed in the interior space of the ornament structure and proximal to the decorative shape formed in the polymer material such that light emitted from the second light source provides a backlighting effect to the decorative shape.

* * * * *

UNITED STATES PATENT AND TRADEMARK OFFICE

CERTIFICATE OF CORRECTION

PATENT NO. : 7,341,360 B2
APPLICATION NO. : 11/241864
DATED : March 11, 2008
INVENTOR(S) : Rebecca M. Richmond et al.

It is certified that error appears in the above-identified patent and that said Letters Patent is hereby corrected as shown below:

In the Claims

Column 13, lines 25-29, "a second decoration device a second ornament structure that is separate from the first decoration device, the second decoration device including a second panel having a second decorative scene that is different from the first decorative scene," should read --a second decoration device including a second ornament structure that is separate from the first decoration device, the second decoration device including a second panel having a second decorative scene that is different from the first decorative scene,--

Signed and Sealed this
Twenty-sixth Day of May, 2015

Michelle K. Lee

Michelle K. Lee
*Director of the United States Patent and Trademark Office*